US007661533B2

(12) United States Patent
Adler et al.

(10) Patent No.: US 7,661,533 B2
(45) **Date of Patent: *Feb. 16, 2010**

(54) BOTTLE WITH SPINE LABEL

(75) Inventors: Deborah B. Adler, New York, NY (US); Klaus Rosburg, New York, NY (US); Patrick L. Douglas, Minneapolis, MN (US); Matthew S. Grisik, Rosemount, MN (US)

(73) Assignee: Target Brands, Inc., Minneapolis, MN (US)

( * ) Notice: Subject to any disclaimer, the term of this patent is extended or adjusted under 35 U.S.C. 154(b) by 154 days.

This patent is subject to a terminal disclaimer.

(21) Appl. No.: 11/862,503

(22) Filed: Sep. 27, 2007

(65) Prior Publication Data

US 2008/0017602 A1 Jan. 24, 2008

Related U.S. Application Data

(63) Continuation of application No. 11/042,907, filed on Jan. 25, 2005, now Pat. No. 7,311,205.

(51) Int. Cl.
*B65D 83/04* (2006.01)
*B65D 85/00* (2006.01)
*G09F 3/00* (2006.01)

(52) U.S. Cl. ..... 206/534; 40/310; 206/459.5

(58) Field of Classification Search ..... 206/232, 206/459.5, 534, 540; 40/306, 310; 215/DIG. 3; 283/81; 116/308; D9/521–522, 550–551
See application file for complete search history.

(56) References Cited

U.S. PATENT DOCUMENTS

D11,149 S 4/1879 Hood (Continued)

FOREIGN PATENT DOCUMENTS

DE 3723671 8/1988

(Continued)

OTHER PUBLICATIONS

"Multi-Dose, Multi-Color, I.V. Bag Rings," www.medidose.com/catalog/ivpharm/bagrings.html, publicly advertised online at least as early as Apr. 27, 2002 based on the internet archive available at www.archive.org (1 page).

(Continued)

*Primary Examiner*—Bryon P Gehman
(74) *Attorney, Agent, or Firm*—Griffiths & Seaton PLLC

(57) ABSTRACT

A bottle includes a container and a label. The container includes a front portion, a back portion, an opening and a spine portion. The back portion is spaced from the front portion and generally faces away and in an opposite direction from the front portion. The opening is positioned between the front portion and the back portion of the container to at least partially define a first end of the container. The spine portion extends between the front portion and the back portion of the container to define a second end of the container opposite the first end. The label extends over and is in contact with each of the front portion, the back portion and the spine portion of the container. Other bottle and container embodiments are also disclosed herein and provide additional advantages.

19 Claims, 13 Drawing Sheets

U.S. PATENT DOCUMENTS

| | | | |
|---|---|---|---|
| D18,997 | S | 4/1889 | Underhill |
| 406,017 | A | 6/1889 | Woodward et al. |
| 605,213 | A | 6/1898 | Weller |
| 624,701 | A | 5/1899 | Stevenson |
| 716,793 | A | 12/1902 | Vogeler |
| D45,565 | S | 4/1914 | Lloyd |
| 1,181,098 | A | 4/1916 | Lambert |
| 1,289,218 | A | 12/1918 | Maiden |
| 1,411,510 | A | 4/1922 | Peterson |
| 1,554,191 | A | 9/1925 | Alexander |
| 1,653,608 | A | 12/1927 | Allen |
| 1,686,354 | A | 10/1928 | Wallace |
| 1,769,147 | A | 7/1930 | Lennon |
| 1,815,268 | A | 7/1931 | Newbery |
| 1,850,369 | A | 3/1932 | Andrews |
| 1,991,871 | A | 2/1935 | Sindler |
| 1,993,978 | A | 3/1935 | Plochman |
| 2,007,685 | A | 7/1935 | Lyle |
| 2,110,768 | A | 3/1938 | Kellogg |
| D128,282 | S | 7/1941 | Gelinas et al. |
| 2,270,277 | A | 1/1942 | Dowd |
| D132,185 | S | 4/1942 | McIntosh |
| 2,328,806 | A | 9/1943 | Hoofer |
| 2,528,259 | A | 10/1950 | Annunziata |
| 2,659,614 | A | 11/1953 | Cook et al. |
| 2,844,893 | A | 7/1958 | Keller |
| 2,847,971 | A | 8/1958 | Painter |
| 2,920,777 | A | 1/1960 | Cole |
| 2,961,108 | A | 11/1960 | Johnson |
| 2,995,265 | A | 8/1961 | Soderberg |
| 3,256,978 | A | 6/1966 | Srigley et al. |
| 3,331,521 | A | 7/1967 | Paige |
| 3,423,861 | A | 1/1969 | Forsyth |
| 3,433,378 | A | 3/1969 | Ross |
| 3,437,194 | A | 4/1969 | Ames et al. |
| 3,625,547 | A | 12/1971 | Burke |
| 3,757,994 | A | 9/1973 | Skoetsch |
| D230,137 | S | 1/1974 | Bettonica |
| 3,787,993 | A | 1/1974 | Lyon |
| 3,822,780 | A | 7/1974 | Ulmer et al. |
| 3,826,222 | A | 7/1974 | Romick |
| 3,850,326 | A | 11/1974 | Ryles |
| 3,923,180 | A | 12/1975 | Fields |
| 3,996,879 | A | 12/1976 | Walton |
| 4,022,352 | A | 5/1977 | Pehr |
| 4,044,889 | A | 8/1977 | Orentreich et al. |
| 4,064,645 | A | 12/1977 | Wood |
| RE29,793 | E | 10/1978 | Pehr |
| 4,143,786 | A | 3/1979 | Goldberg et al. |
| 4,150,760 | A | 4/1979 | d'Orgelys |
| D255,054 | S | 5/1980 | Kingsford |
| 4,246,709 | A | 1/1981 | Selleslags |
| 4,263,734 | A | 4/1981 | Bradshaw |
| 4,284,200 | A | 8/1981 | Bush et al. |
| 4,285,489 | A | 8/1981 | Blanchard |
| 4,334,638 | A | 6/1982 | Stock |
| D270,998 | S | 10/1983 | Stark |
| D274,309 | S | 6/1984 | Aldrich, III |
| 4,535,903 | A | 8/1985 | Franchi |
| D280,601 | S | 9/1985 | Biesecker |
| D282,909 | S | 3/1986 | Biesecker |
| D285,535 | S | 9/1986 | Buchholz et al. |
| 4,732,411 | A | 3/1988 | Siegel |
| 4,799,712 | A | 1/1989 | Biava et al. |
| D300,119 | S | 3/1989 | Pacquin |
| 4,813,570 | A | 3/1989 | Pontoppidan |
| 4,819,351 | A | 4/1989 | Boitani |
| 4,860,899 | A | 8/1989 | McKee |
| 4,863,026 | A | 9/1989 | Perkowski |
| 4,868,027 | A | 9/1989 | Hunkeler et al. |
| 4,881,648 | A | 11/1989 | Hagerty |
| 4,883,180 | A | 11/1989 | Humphrey et al. |
| D305,505 | S | 1/1990 | Kunesh |
| 4,890,742 | A | 1/1990 | Allison |
| 4,913,083 | A | 4/1990 | Valvo et al. |
| 4,918,604 | A | 4/1990 | Baum |
| 4,919,285 | A | 4/1990 | Roof et al. |
| 4,941,573 | A | 7/1990 | Fuerstman |
| 4,972,657 | A | 11/1990 | McKee |
| 4,991,877 | A | 2/1991 | Lieberman |
| 5,011,032 | A | 4/1991 | Rollman |
| 5,020,682 | A | 6/1991 | Dutt |
| D319,181 | S | 8/1991 | Balavich |
| 5,048,870 | A | 9/1991 | Mangini et al. |
| D323,780 | S | 2/1992 | Addante |
| D324,994 | S | 3/1992 | Jentgen |
| 5,102,169 | A | 4/1992 | Mayfield |
| D328,246 | S | 7/1992 | Nottingham et al. |
| 5,145,080 | A | 9/1992 | Imbery, Jr. |
| 5,165,546 | A | 11/1992 | Jaeger et al. |
| 5,172,936 | A | 12/1992 | Sullivan et al. |
| 5,178,311 | A | 1/1993 | McBride |
| D333,618 | S | 3/1993 | Patel et al. |
| 5,193,032 | A | 3/1993 | Hirth |
| 5,204,775 | A | 4/1993 | McDevitt |
| 5,215,334 | A | 6/1993 | Presson et al. |
| 5,261,702 | A | 11/1993 | Mayfield |
| D342,452 | S | 12/1993 | Monaghan |
| 5,284,363 | A | 2/1994 | Gartner et al. |
| 5,301,802 | A | 4/1994 | Nemeroff |
| 5,309,279 | A | 5/1994 | Halstead |
| 5,342,093 | A | 8/1994 | Weernink |
| D350,691 | S | 9/1994 | Simion |
| 5,343,647 | A | 9/1994 | Bulka |
| 5,346,069 | A | 9/1994 | Intini |
| D351,796 | S | 10/1994 | Deddens |
| 5,351,991 | A | 10/1994 | McDonald |
| D355,125 | S | 2/1995 | Patel et al. |
| D355,126 | S | 2/1995 | Paulovich et al. |
| 5,403,636 | A | 4/1995 | Crum |
| D360,134 | S | 7/1995 | Snyder |
| 5,448,844 | A | 9/1995 | Miller, Jr. et al. |
| 5,476,420 | A | 12/1995 | Manning |
| 5,495,944 | A | 3/1996 | Lermer |
| D370,636 | S | 6/1996 | Crawford |
| 5,588,239 | A | 12/1996 | Anderson |
| 5,601,314 | A | 2/1997 | Burns et al. |
| 5,642,906 | A | 7/1997 | Foote et al. |
| 5,660,138 | A | 8/1997 | Hirsch |
| 5,662,239 | A | 9/1997 | Heuvelman |
| D389,064 | S | 1/1998 | Sethi et al. |
| 5,704,144 | A | 1/1998 | Groth |
| 5,704,648 | A | 1/1998 | Brown et al. |
| 5,713,681 | A | 2/1998 | Venne et al. |
| 5,718,347 | A | 2/1998 | Walker et al. |
| 5,719,828 | A | 2/1998 | Haas et al. |
| 5,729,922 | A | 3/1998 | Peterson et al. |
| 5,730,292 | A | 3/1998 | Jones |
| 5,758,440 | A | 6/1998 | Yudin |
| 5,760,975 | A | 6/1998 | DiGiovanni |
| D395,828 | S | 7/1998 | Lecoule |
| 5,779,072 | A | 7/1998 | Krebs |
| 5,788,974 | A | 8/1998 | D'Amico et al. |
| 5,799,815 | A | 9/1998 | Lang |
| 5,800,144 | A | 9/1998 | Glenn et al. |
| 5,829,789 | A | 11/1998 | Treleaven et al. |
| 5,887,736 | A | 3/1999 | Mar |
| 5,918,758 | A | 7/1999 | Galton-Fenzi |
| D413,067 | S | 8/1999 | Haley |
| 5,980,352 | A | 11/1999 | Rigberg |
| 6,003,902 | A | 12/1999 | Petkovsek |
| D419,077 | S | 1/2000 | Sultan |
| 6,023,865 | A | 2/2000 | Preuss |
| D423,361 | S | 4/2000 | Negre |

| | | | |
|---|---|---|---|
| 6,068,300 | A | 5/2000 | Vijuk et al. |
| D427,073 | S | 6/2000 | Gaffney et al. |
| 6,081,392 | A | 6/2000 | Pensmith |
| 6,086,702 | A | 7/2000 | Rea |
| D430,802 | S | 9/2000 | Adachi et al. |
| 6,158,779 | A | 12/2000 | Petrick |
| 6,196,593 | B1 | 3/2001 | Petrick et al. |
| 6,209,921 | B1 | 4/2001 | Hogan et al. |
| 6,220,439 | B1 | 4/2001 | Virvo |
| 6,226,564 | B1 | 5/2001 | Stuart |
| 6,241,844 | B1 | 6/2001 | Petkovsek |
| D445,338 | S | 7/2001 | Helleu |
| 6,270,121 | B1 | 8/2001 | Dolan et al. |
| 6,276,725 | B1 | 8/2001 | Laurash et al. |
| 6,278,545 | B1 | 8/2001 | Napier |
| D447,694 | S | 9/2001 | Leggett |
| 6,360,462 | B1 | 3/2002 | Mengel |
| D456,271 | S | 4/2002 | Maloney |
| 6,366,401 | B1 | 4/2002 | Gonda et al. |
| 6,367,639 | B1 | 4/2002 | Mar |
| 6,367,640 | B1 | 4/2002 | Julian |
| 6,379,007 | B1 | 4/2002 | Farb |
| D457,063 | S | 5/2002 | Bakic |
| 6,386,367 | B1 | 5/2002 | Bayliss, IV |
| D459,212 | S | 6/2002 | Gobe |
| 6,402,872 | B1 | 6/2002 | Key |
| 6,491,164 | B1 | 12/2002 | Virvo |
| D470,415 | S | 2/2003 | Weber |
| 6,549,345 | B1 | 4/2003 | Cardarelli |
| D474,690 | S | 5/2003 | Bakic |
| 6,568,530 | B2 | 5/2003 | Takahashi et al. |
| 6,594,928 | B1 | 7/2003 | Clawson et al. |
| D480,002 | S | 9/2003 | Canepa |
| D480,005 | S | 9/2003 | Conway |
| 6,621,629 | B2 | 9/2003 | Blumenthal et al. |
| D480,960 | S | 10/2003 | Gray et al. |
| 6,669,804 | B2 | 12/2003 | Pendry et al. |
| 6,681,945 | B1 | 1/2004 | Harrold |
| 6,712,398 | B1 | 3/2004 | Fox et al. |
| 6,722,495 | B2 | 4/2004 | Fresnel |
| 6,745,505 | B2 | 6/2004 | Moran |
| 6,752,272 | B2 | 6/2004 | Jones et al. |
| D497,311 | S | 10/2004 | Walsh et al. |
| 7,413,082 | B2 | 1/2005 | Adler |
| 6,860,390 | B2 | 3/2005 | Bowman |
| 6,860,513 | B2 | 3/2005 | Kaufman |
| 6,964,345 | B2 | 11/2005 | Wetherell, Jr. et al. |
| D520,365 | S | 5/2006 | Andoh |
| D522,867 | S | 6/2006 | Bakic |
| D526,569 | S | 8/2006 | Wurster et al. |
| D539,651 | S | 4/2007 | Snyder |
| D540,179 | S | 4/2007 | Adler et al. |
| D540,690 | S | 4/2007 | Adler et al. |
| D541,159 | S | 4/2007 | Robinson |
| D542,661 | S | 5/2007 | Adler et al. |
| 7,225,937 | B2 | 6/2007 | Schroeder |
| 7,311,205 | B2 | 12/2007 | Adler et al. |
| D566,330 | S | 4/2008 | Angeletta |
| 2001/0017817 | A1 | 8/2001 | De La Huerga |
| 2001/0054817 | A1 | 12/2001 | Kelley et al. |
| 2002/0020088 | A1 | 2/2002 | Kreutner |
| 2002/0041091 | A1 | 4/2002 | Eippert |
| 2002/0063739 | A1 | 5/2002 | Gosden et al. |
| 2002/0088732 | A1 | 7/2002 | Takahashi et al. |
| 2002/0129758 | A1 | 9/2002 | Hanley et al. |
| 2002/0162261 | A1 | 11/2002 | West et al. |
| 2002/0171238 | A1 | 11/2002 | Kozlowski et al. |
| 2003/0025320 | A1 | 2/2003 | Shoemaker |
| 2003/0028392 | A1 | 2/2003 | Davies |
| 2003/0091687 | A1 | 5/2003 | Copelan |
| 2003/0127351 | A1 | 7/2003 | Takahashi et al. |
| 2003/0147450 | A1 | 8/2003 | Witonsky et al. |
| 2003/0192211 | A1 | 10/2003 | Elias |
| 2003/0193181 | A1 | 10/2003 | Hung |
| 2003/0193185 | A1 | 10/2003 | Valley et al. |
| 2003/0205897 | A1 | 11/2003 | Kaufman |
| 2003/0214129 | A1 | 11/2003 | Adler |
| 2004/0045863 | A1 | 3/2004 | Rhoades |
| 2004/0050750 | A1 | 3/2004 | Hannan et al. |
| 2004/0056479 | A1 | 3/2004 | Fox et al. |
| 2004/0075272 | A1 | 4/2004 | Kaufman |
| 2004/0193454 | A1 | 9/2004 | Foote et al. |
| 2004/0232023 | A1 | 11/2004 | Bansal et al. |
| 2004/0237311 | A1 | 12/2004 | Brown et al. |
| 2006/0163103 | A1 | 7/2006 | Adler et al. |
| 2006/0163869 | A1 | 7/2006 | Adler et al. |
| 2007/0029788 | A1 | 2/2007 | Adler |
| 2007/0102316 | A1 | 5/2007 | Van Der Krogt et al. |

FOREIGN PATENT DOCUMENTS

| | | | |
|---|---|---|---|
| EP | 0146095 | | 6/1985 |
| EP | 0316636 | A2 | 5/1989 |
| EP | 0609955 | B1 | 4/1998 |
| EP | 0609954 | B1 | 7/1998 |
| EP | 0924676 | A2 | 6/1999 |
| FR | 2296391 | | 7/1976 |
| GB | 2006713 | A | 5/1979 |
| JP | 10297640 | | 11/1998 |
| WO | 03/098275 | A2 | 11/2003 |
| WO | 2004048216 | A1 | 6/2004 |

OTHER PUBLICATIONS

U.S. Appl. No. 29/326,399, filed on Oct. 16, 2008, Bottle Contour, Adler et al., 11 pages.

International Search Report, mailed Jan. 18, 2006, and Written Opinion, mailed Jul. 25, 2007, from International Patent Application. No. PCT/US2005/019401.

U.S. Appl. No. 29/277,823, filed Mar. 9, 2007.

U.S. Appl. No. 29/277,825, filed Mar. 9, 2007.

U.S. Appl. No. 11/862,503, filed Sep. 27, 2007.

U.S. Appl. No. 29/278,438, filed Mar. 29, 2007.

U.S. Appl. No. 29/278,568, filed Apr. 2, 2007.

BOTTLE WITH SPINE LABEL

CROSS-REFERENCE TO RELATED APPLICATION

This application is a continuation of and claims priority under 35 U.S.C. §120 to U.S. patent application Ser. No. 11/042,907, filed Jan. 25, 2005 and entitled "Pharmacy Bottle System," which is incorporated herein in its entirety.

BACKGROUND OF THE INVENTION

Virtually everyone consumes prescription pharmaceuticals at one time or another. In each instance, the consumer is faced with a series of procedural steps and information. The procedural steps include submitting the prescription, waiting for it, picking up the prescription, and signing applicable notices. In some cases, the prescription is modified to satisfy the demands of the patient's insurance company. A large volume of information about the patient, pharmacy, physician, and drug is provided on the prescription sticker on the bottle, juxtaposed with numerous warning or cautionary labels haphazardly placed on the bottle. Additional information is provided on one or more printed, folded sheets, which are included with the prescription bottle.

Faced with this relatively chaotic presentation of seemingly obscure facts and requests, consumers can easily misunderstand many aspects related to their prescription. This situation is compounded when a consumer takes several prescriptions and/or when several members of the household each have one or more prescriptions, causing the multiple instructions and warnings to become overwhelming.

In addition, conventional pharmacy bottles can be difficult to grasp when opening, particularly for patients with arthritis and/or limited joint mobility and strength. Reduced vision also is a problem since distinguishing between multiple similar bottles requires very close inspection of the already confusing combination of the warnings and prescription label.

Given the importance of accuracy in consuming prescription medicine, the current confusion and difficulty for patient's to read and understand pharmaceutical prescription information is not acceptable.

SUMMARY OF THE INVENTION

In one embodiment, a bottle includes a container and a label. The container includes a front portion, a back portion, an opening and a spine portion. The back portion is spaced from the front portion and generally faces away and in an opposite direction from the front portion. The opening is positioned between the front portion and the back portion of the container to at least partially define a first end of the container. The spine portion extends between the front portion and the back portion of the container to define a second end of the container opposite the first end. The label extends over and is in contact with each of the front portion, the back portion and the spine portion of the container. Other embodiments are also disclosed herein and provide additional advantages.

BRIEF DESCRIPTION OF THE DRAWINGS

Embodiments of the invention will be described with respect to the figures, in which like reference numerals denote like elements, and in which.

DETAILED DESCRIPTION

Figure 1:
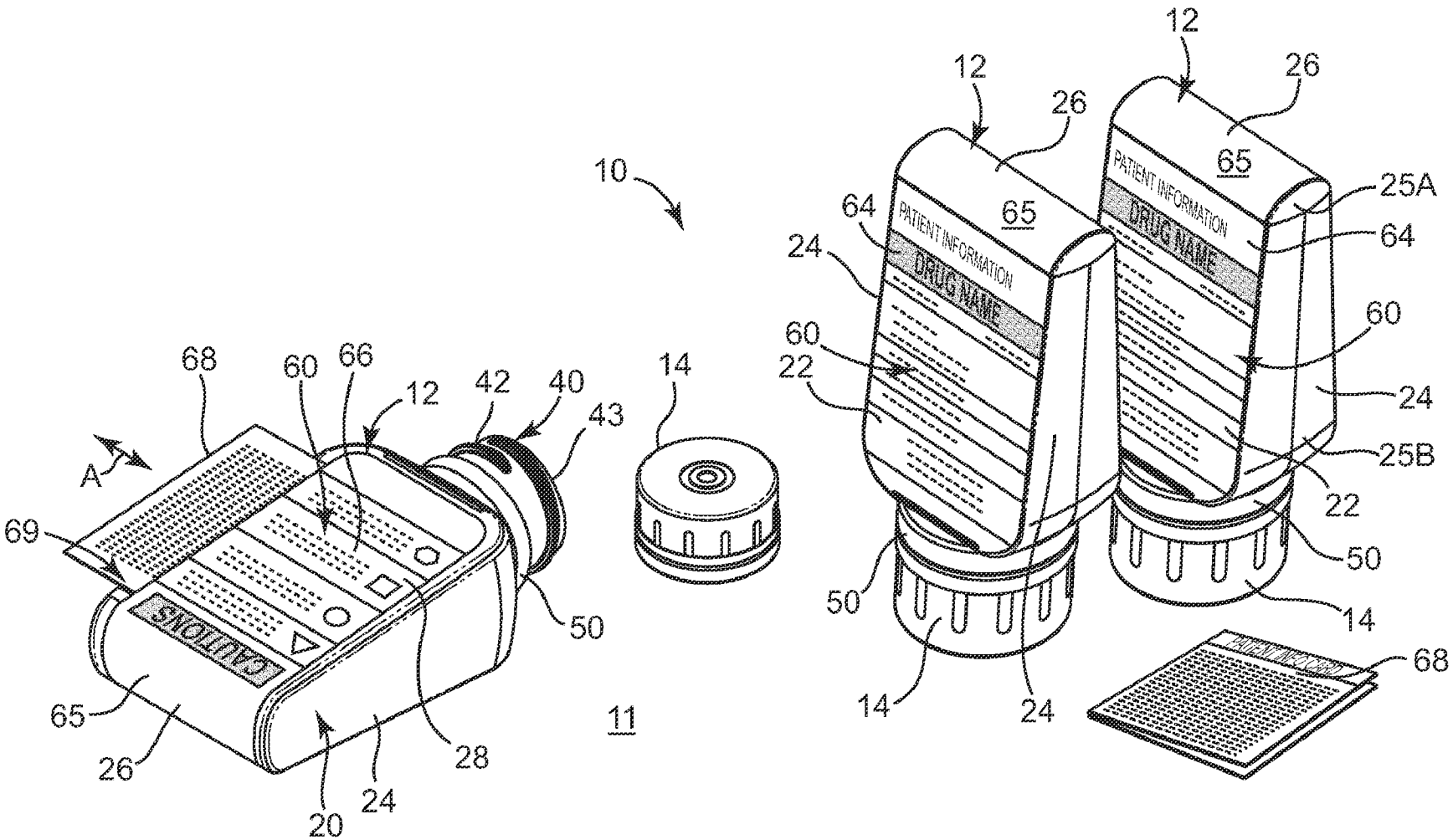
FIG. 1 is a schematic illustration, including isometric views of a pharmacy bottle system including a plurality of bottles, according to an embodiment of the invention.

In the following detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Embodiments of the invention are directed to a pharmacy bottle system and label system that significantly enhances a consumer's experience in filling a prescription at a retail pharmacy. In one embodiment, a pharmacy bottle system comprises a container, label, color ring, and a cap. The bottle container is sized and shaped to hold a medication from a prescription, such as pills, syrup, or other forms of medication. The bottle container includes a pair of generally flat, relatively large surfaces on opposite sides of the container for bearing the label, thereby making the label substantially easier to read. The label is configured for placement as a single piece or separate pieces, depending upon the type or size of the bottle container, to cover both of the opposite faces of the bottle container. Each label differentiates between types of information by segregating the different types of information onto different areas of the container and/or onto different areas of the label. In one embodiment, warning information is placed on a second portion of the label that is applied to a back portion of the bottle container, while conventional prescription information, such as patient name, drug name, physician name etc. is placed on a first portion of the label that is applied to a front portion of the bottle container. In one aspect, this arrangement of the location of the different types of information becomes fixed from prescription to prescription, so that a particular type of prescription-related information (e.g., drug name, warnings, patient name) is found at a fixed, dedicated location on the label and/or portion of bottle container each time a consumer fills a prescription.

In another embodiment, information on a portion of the label (e.g. a front portion or back portion) is further differentiated into primary information such as patient name, drug name and dose, and usage instructions and secondary information such as physician name/address, pharmacy name/address, etc. The primary information is presented in larger and/or bolder fonts, spaced away from secondary information, so that primary information conspicuously stands out to the consumer. In another embodiment, primary information is placed at an upper portion of the label and bottle container since it is the information most often required and used, with secondary information placed at a lower portion of label and bottle container to reflect its less frequent use.

In one embodiment, a bottle container is configured with a reverse orientation so that when a prescription label is applied to the container, the bottle appears right side up when its cap is in contact with a support surface (e.g. counter or table) and the container extends vertically upward from the cap in a manner that would initially appear to be upside down. The label on the bottle is configured with its text oriented to be read on the label with the bottle in this reverse orientation (e.g., cap down, container up). In one aspect, at least one face of the bottle container (that displays the label) is tilted slightly at an angle (relative to a vertical plane), so that the label can be read more easily when the bottle is supported on its cap, or held by a patient, in the reverse orientation (e.g., cap down, container up).

In one embodiment, a resilient, flexible colored ring is removably mounted around a mouth of the bottle container with different color rings being used by a pharmacy to aid consumers in distinguishing among prescriptions for different family members or among multiple types of medications for an individual. Each family member, or each type of medication, is assigned a different color.

In one embodiment, a bottle container and label are configured to form a slot on a back portion (or front portion) of the pharmacy bottle for removably receiving a patient information card within the slot. In another embodiment, a magnifying tool is substituted for the information card. In one aspect, the slot is oriented to enable slidable insertion and removal of the patient information card, and sized and shaped to enable a small portion of the card to protrude out of the slot (when fully inserted within the slot) to unobtrusively draw attention to the presence of the patient information card.

A label applied to the bottle container, the patient card, as well as other labels and printed information associated with filling prescriptions is provided by a label system. The label system comprises a complete integrated set of labels, sheets, and cards that is generated for each prescription by the pharmacist to expedite processing the prescription. In one embodiment, the label system is generated and customizable by a control monitor, via a user interface, operable by the pharmacist or retail administration. The label system also includes information such a patient monograph or other items that is generated along with the other labels, sheets, and cards when filling a prescription, so that the label system provides a single tool for producing all printed information used to process a prescription.

In another embodiment, different types of bottles enable different ways to enhance readability of printed information and patient handling of the bottles. Each of the different types of bottles in embodiments of the invention are used with the same label system, which is already adapted for application to the different types of bottles without requiring specific customization of the label each time a different type of bottle is used.

These embodiments and other embodiments of the invention are described and illustrated in greater detail in association with FIGS. 1-13C.

As shown in FIG. 1, in one embodiment, pharmacy bottle system 10 comprises a plurality of bottles 12 with a cap 14 and ring 50 on each bottle 12. Each bottle 12 comprises a container 20 and a label 60. Container 20 comprises front portion 22, side portion 24, spine portion 26, rear portion 28, and mouth 40. Mouth 40 includes opening 43 and threaded neck 42 for threadably engaging cap 14 to cover opening 43.

As shown in FIG. 1, label 60 is adhesively secured to container 20. Label 60 comprises a mechanism to display all prescription related information on a face of bottle 12, including patient information, drug information, physician information, retail pharmacy information, etc which is strategically distributed throughout front portion 64, spine portion 65, and back portion 66 of label 60.

In addition, back portion 66 of label 60 and back portion 28 of container 20 form a slot 69 which is adapted to removably receive information card 68, such as a patient information card which provides more extensive information, such as side effects, detailed manner of use, contraindications, pill description, etc. Information card 68 is sized and shaped to be removably insertable into slot 69, either as a single sheet or folded sheet. In one embodiment, slot 69 is oriented laterally so that information card 68 is slidable laterally relative to rear portion 66 of container 20, in a direction generally transverse to a longitudinal axis of container 20 (shown as line A in FIG. 3A). This orientation causes information card 68 to protrude slightly outward from slot 69, as shown in FIGS. 1 and 2A, making information card 68 easily noticeable by a consumer in a manner that does not obscure the faces of label 60 nor detract from the overall function (e.g., does not obstruct operation of cap 14) and appearance of bottle 12.

Container 20 presents a unique combination of different shapes, surfaces, and features in one bottle 12. First, bottle 12 stands upright on a support surface 11, such as a table or counter, by placing cap 14 down onto the support surface 11 to cause container 20 to extend upwardly from support surface 11. In this orientation, spine portion 26 is considered a top of bottle 12 while cap 14 (which covers a mouth of bottle 12) is considered a bottom of bottle 12. From the standpoint of a conventional pharmacy bottle, this feature causes pharmacy bottle 12 to appear upside-down in orientation. However, this seemingly upside-down orientation of bottle 12 is actually a right-side-up orientation and maximizes readability of label 60 on container 20 and presents unique ways of handling a pharmacy bottle 12, as further described below. Moreover, this right-side-up orientation can be achieved by manually holding bottle 12 with spine portion 26 in a relatively higher position relative to cap 14 so that label 60 on bottle 12 can be read in an orientation from the spine portion 26 toward cap 14.

Second, in one embodiment, front portion 22 and back portion 28 of container 20 define a substantially planar surface that is rectangularly shaped, thereby defining a generally flat, broad surface especially suited for reading information on label 60. For example, this surface enables display of information in a manner in which all of the printed information on that surface can be read without turning or rotating bottle 12. In one embodiment, front portion 22 and back portion 28 of container 20 each extend at a slight angle relative to a vertical plane (shown as vertical plane V in FIG. 2B), so that when cap bottle is set on a support surface 11 (via cap 14), front portion 22 and back portion 28 are tilted slightly upward to improve readability of label 60. This easy-read tilting feature is enabled by the size, shape, and position of side portions 24, relative to front portion 22 and back portion 24 of container 20.

Third, as shown in FIG. 1 (and 2A-2B) side portions 24 of container 20 are generally trapezoidally shaped, being interposed between front portion 22 and back portion 28. Each side portion 24 has a top portion 25A that is positioned adjacent to and that is joined to spine portion 26 of container 20, a top portion of front portion 22 of container 20, and a top portion of back portion 28 of container 20. Each side portion 24 also has a base portion 25B that is positioned adjacent to and that is joined to mouth 40 of container at a bottom portion of front portion 22 of container 20 and a bottom portion of back portion 28 of container 20. In one embodiment, base portion 25B of each side portion 24 is relatively longer than a length of top portion 25A of each side portion 24, thereby producing the easy-read tilt feature of bottle 12. In one embodiment, the relative length between top portion 25A and base portion 25B is selected to produce a desired degree of tilt, which partially determines tilt angles ($\alpha 1$, $\alpha 2$, and $\alpha 3$) illustrated in FIG. 2B. Accordingly, the generally trapezoidal shape of side portions 24 contributes to the easy-read tilt feature of front and back portions 22 and 28 of container 20.

Fourth, as shown in FIG. 1, relatively broad, substantially planar front and back portions 22, 28 of container 20 also enable a bottle 12 to be set down onto a support surface 11 without the bottle 12 rolling along the support surface 11. In particular, the breadth and relative flatness of front portion 22 or back portion 28 prevent rolling of bottles when either one of those front or back portions 22, 28 are placed directly on support surface 11.

Spine portion 26 of container 20 comprises a slightly curved surface, providing a junction between front portion 22, back portion 28 and side portions 24. Side portions 24, front portion 22, and back portion 28 also join each other adjacent mouth 40.

Bottle 12 comprises multiple distinct profiles, depending upon the view taken of bottle 12, with each profile uniquely enhancing a patient's experience with bottle 12. In a first view, in which a consumer directly faces front portion 22 or back portion 28 of container 20, bottle 12 has a wide profile and generally flat, rectangular appearance. In a second view, in which a consumer directly faces either one of side portions 24 of container 20, bottle 12 has a narrow profile and a generally flat, trapezoidal appearance (or generally cone-shaped appearance). Bottle 12 also includes at least one more distinct profile that is seen when directly facing spine portion 26, which reveals a relatively narrow profile.

Accordingly, the combination of these three distinct profiles presents a radically different pharmacy bottle, with the distinct profiles contributing to the enhanced presentation of prescription-related information to the patient, as well as handling, storage, and retrieval of the bottle, as further described throughout this application.

In one embodiment, front portion 22 and back portion 28 are generally symmetric with each other regarding a size and general shape (e.g., generally rectangular) and side portions 24 are generally symmetric with each other regarding a size and general shape (e.g., generally trapezoidal). In another embodiment, front portion 22 and back portion 28 are generally asymmetric with each other regarding a size or a general shape and side portions 24 are generally asymmetric with each other regarding a size or a general shape.

In one embodiment, bottle 12 comprises ring 50. Ring 50 encircles a portion of threaded neck 42 and includes a color component for uniquely distinguishing between different bottles 12. In one embodiment, one color ring 50 represents a first type of medication while a second color ring represents a second type of medication. In another embodiment, one color ring 50 represents a first member of a patient's family while a second, different colored ring 50 represents a second member of the same patient's family. Additional uniquely colored rings can represent additional types of medication or additional family members, respectively. In another embodiment, different colored rings represent other parameters useful for uniquely identifying each single bottle among a plurality of bottles 12. In another embodiment, ring 50 is not mounted to bottle 12 for using color differentiation via ring 50. In another embodiment, ring 50 is removably mounted to bottle 12 but comprises a neutral color that does not differentiate between different bottles, such as the color of container 20. Accordingly, ring 50 further contributes to easy-to-follow presentation of information to the patient and others.

Figure 4:
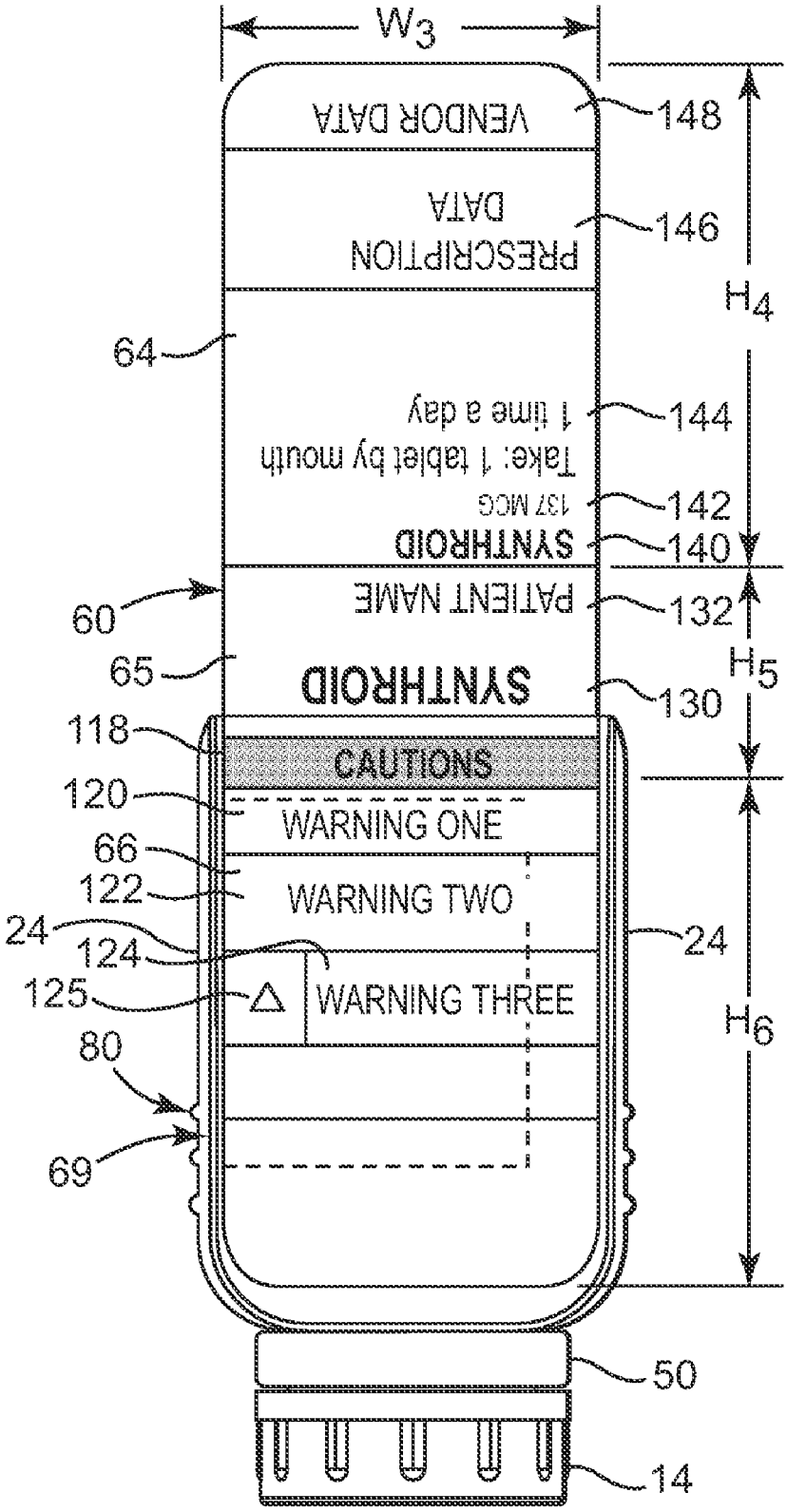
FIG. 4 is a plan view of a pharmacy bottle schematically illustrating a partially applied label, according to an embodiment of the invention.

In addition to the benefits of the placement and orientation of label 60 on the various surfaces of container 20, label 60 includes additional features. In one embodiment, label 60 includes front portion 64, spine portion 65, and back portion 66. Front portion 64 of label 60 comprises, among other things, a patient identifier and a drug identifier while back portion 66 comprises warnings. Spine portion 65 comprises a patient identifier or drug identifier, as shown in FIG. 4.

The segregation of the different types of information onto different portions of label 60, and therefore onto different portions of bottle 12, contribute to patient readability of pharmacy bottle 12. In one embodiment, front portion 64, spine portion 65, and back portion 66 of label 60 directly correspond to front portion 22, spine portion 26, and back portion 28 of container 20, respectively, to cause viewing of each type of information on bottle 12 on a separate face of bottle 12. In addition, front portion 64, spine portion 65, and back portion 66 of label 60 present three different readable faces of bottle 12 that are generally perpendicular to each other. Two of the faces, front portion 64 and back portion 66 of label 60, when applied to container 20, face in opposite directions relative to bottle 12, and hence are at a generally 180 degree angle relative to each other. Accordingly, in one embodiment, container 20 presents a three-faced container 20, with each face being generally perpendicular to each other so that in coordination with the three distinct portions of label 60 (e.g., front portion 64, spine portion 65, and back portions 66), bottle 12 provides three distinct, highly segregated reading surfaces for patient. This feature enhances separation of prescription-related information onto different areas of bottle 12. Moreover, once a pharmacist or retailer designates one of the faces (e.g., a back face) of container 20 for a particular type of information (e.g., warning), the patient can rely on the same type of information being presented at that location of bottle 12 whenever a prescription is filled from that pharmacist or retailer. This feature reduces patient confusion, since a patient no longer has to search over the face of a conventional pharmacy bottle to determine where each piece of information is located in order to be able to coherently read the information on the pharmacy bottle.

In addition, in another embodiment, label 60 includes additional features for segregating information to ease patient readability of bottle 12. For example, as seen in FIG. 1, front portion 64 of label 60 includes a drug identifier (e.g., a drug name in FIG. 1 or AMOXYCILLIN in FIG. 2A) that is presented in a large font, substantially larger than a font on front portion 64 to facilitate quick differentiation of one pharmacy bottle 12 relative to other pharmacy bottles 12. In one embodiment, as shown in FIGS. 1 and 2A, a drug identifier is also configured in a bold font, in contrast to a normal font for other information on front portion 64 of label 60. In another embodiment, a drug identifier additionally comprises a colored text or a background having a color or grey-level intensity (e.g., grey shading) that is different than a color or shading of a background of other information (e.g., white) on front portion 64 of label 60 to further distinguish drug name on front portion 64 of label 60.

In one embodiment, spine portion 65 of label 60 is blank, as shown in FIGS. 1 and 2A to relieve the patient of viewing too much information. In another embodiment, spine portion 65 of label 60 comprises a drug identifier and/or patient identifier in a prominently displayed, large font, as further illustrated in association with FIG. 4. This feature enables easy differentiation of one pharmacy bottle 12 from another based on a type of prescription or patient identity when viewing bottle 12 from a viewing angle on spine portion 26, particularly where viewing front portion 64 or back portion 66 of label 60 is not possible or less convenient to patient.

Back portion 66 of label 60 comprises warnings extending horizontally across back portion 66 in a stacked, generally parallel arrangement. As shown in FIG. 1, in one embodiment, one or more warnings include a pictogram, icon, or other symbol (e.g., a square, triangle, circle, etc.) unique to a particular warning or condition, and that is positioned immediately to the left of the text of the warning, thereby providing an easy visual message to the reader. These symbols are particularly useful for consumers having limited reading ability, because of language challenges or eyesight problems.

Additional aspects of label 60 will be described in more detail, particularly in association with FIGS. 4-7, and more generally in association with FIGS. 2-13C.

Accordingly, the full combination and interaction of the container, ring, label, and cap present an entirely different experience for a patient to use a pharmacy bottle, according to the embodiments of the invention. FIGS. 3A-13C present additional aspects of these embodiments.

Figure 2B:
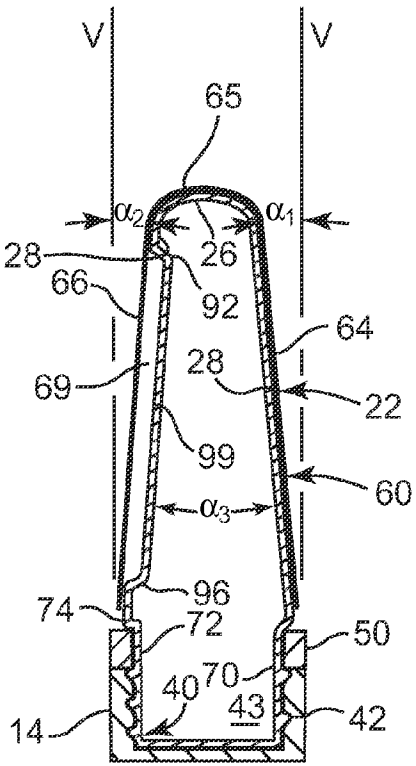
FIG. 2B is sectional view of FIG. 2A taken along lines 2B-2B.
Figure 2A:
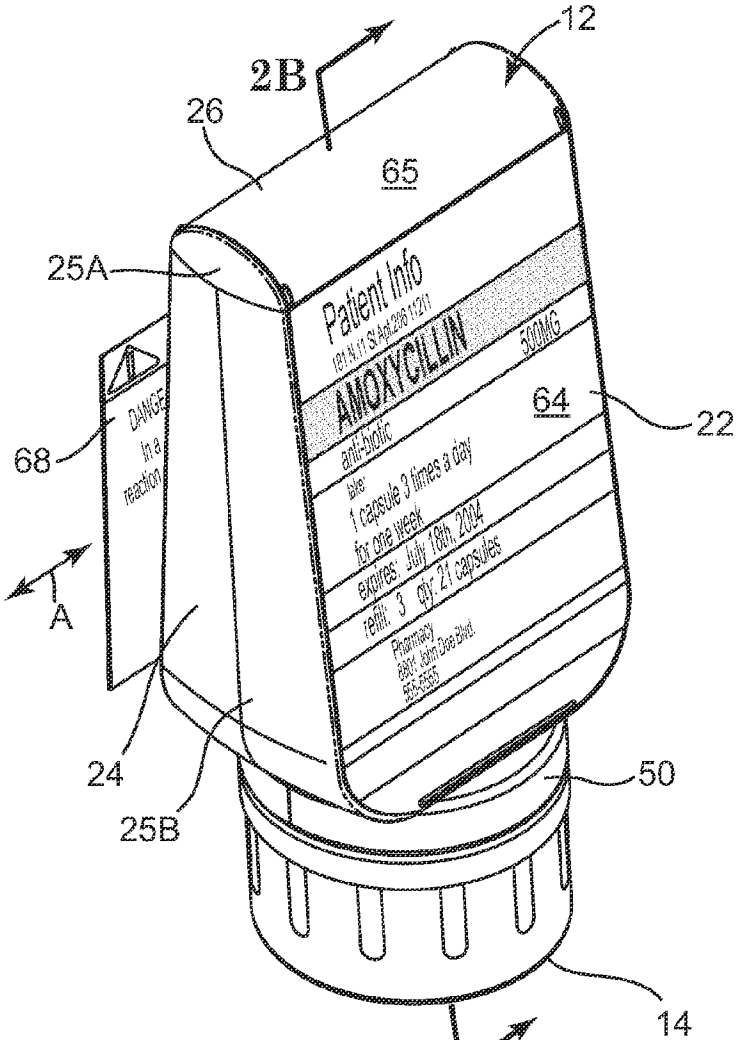
FIG. 2A is an isometric view of a pharmacy bottle, according to an embodiment of the invention.

FIGS. 2A-2B further illustrate the easy-read tilt feature of front portions and back portions 22 and 28 of bottle 12, respectively. FIG. 2A is an isometric view of bottle 12 with label 60 and FIG. 2B is a sectional view of FIG. 2A taken along lines 2B-2B.

In one embodiment, as shown in FIG. 2B, a first angle ($\alpha$1) between the front portion 22 and a generally vertical plane (shown as line V in FIG. 2B), and a second angle ($\alpha$2) between back portion 28 of container 20 and a generally vertical plane (V), is about 5 degrees while third angle ($\alpha$3) is about 10 degrees. The first angle ($\alpha$1) between front portion 22 and the generally vertical plane (V), and the second angle ($\alpha$2) between back portion 28 and a generally vertical plane (V) are substantially identical. In another embodiment, the first angle ($\alpha$1) and second angle ($\alpha$2) can be larger or smaller than about 5 degrees to achieve a desired degree of vertical tilt of front portion 22 and back portion 28 to adjust readability of label 60. In one embodiment, angles ($\alpha$1) and ($\alpha$2) are about 2 to 20 degrees while angle ($\alpha$3) is about 4 to 40 degrees.

In another embodiment, the first angle ($\alpha$1) between front portion 22 relative to a generally vertical plane (V) and the second angle ($\alpha$2) between back portion 28 relative to a generally vertical plane (V) are different from each other, thereby enabling one of the back portion 28 or the front portion 22 to extend at less of an angle relative to a generally vertical plane (V) and the respective other front portion 22 or back portion 28 to extend at a more of angle relative to that generally vertical plane (V). This feature enables favoring readability of one of the front portion 22 or back portion 28 (with a greater tilt angle) relative to the respective front portion or back portion 28 (with a lesser tilt angle).

Accordingly, as shown in FIG. 2B, the generally trapezoidal shape of side portions 24 cause front portion 22 of container 20 and back portion 28 of container 20 to be oriented to converge with each other adjacent spine portion 26 of container 20 and to be oriented to diverge relative to each other adjacent mouth 40 of container 20.

FIGS. 2A-2B also further illustrate features relating to removable insertion of patient information card 68, and its protrusion from slot 69 in its fully inserted state. As shown in FIG. 2B, back portion 28 of container 20 further comprises recess 90 having recess surface 99 and edges 92 and 96. Recess surface 99 is a depression formed in the surface of back portion 28 of container 20. Back portion 66 of label 60 is secured onto back portion 28 of container 20 wherein a substantial potion of back portion 66 extends over recess surface 99, thereby forming slot 69. Recess surface 99 is sized and shaped, and has a depth relative to the remainder of back portion 28 of container 20 and relative to a thickness of information card 68, to enable slidable reception of information card 68 (when recess 90 is covered by back portion 66 of label 60). Recess 90 is further described and illustrated in association with FIG. 3C.

As shown in FIG. 2B (and FIG. 3B), third angle ($\alpha$3) is formed within container 20 between front portion 22 and back portion 28, with spine portion 26 generally defining a vertex of that angle. This third angle expresses a general convergence of front portion 22 and back portion 28 adjacent spine portion 26. In addition, front portion 22 and back portion 28 of container 20 (expressed by width W2) are relatively wide surfaces, being substantially wider than a width of cap 14 or opening 43 of mouth 40. Along with the general convergence of front portion 22 and back portion 28 of container 20 near spine portion 26 (due to the generally trapezoidal shape of side portions 24), this wide-bottle arrangement enables grasping of container 20 between a thumb and fingers of one hand with the thumb on one of front portion 22 or back portion 28, and the fingers placed on a respective one of front portion 22 or back portion 28. This opposed thumb-forefinger grip is easier for some people suffering from reduced mobility and flexibility in their hands and fingers, as compared to gripping of a conventional generally cylindrical pharmacy bottle with a fist-type gripping action. Moreover, when the consumer grasps cap 14 in their other hand to begin removing cap 14, the relatively wide surface of front portions 22 and back portions 28 enable the full width of fingers to be spread across those surfaces, enabling greater leverage to rotate cap 14 relative to container 20, or vice versa. In particular, the ability to exert forces at distances further away from an axis of rotation (A) of container 20 and cap 14 reduces the amount of hand force required to cause rotational motion necessary to rotate cap relative to threaded neck 42 of mouth 40 of container 20.

As also shown in FIG. 2B, mouth 40 of container 20 further comprises collar 70, neck 72, and shoulder 74. Collar 70 is formed as part of threaded neck 42 while shoulder 74 defines a junction between mouth 40 and the remainder (e.g., a body) of container 20 via neck 72. Ring 50 slidably fits over threaded neck 42 (including collar 70) onto neck 72, and is held in place at that location by collar 70, shoulder 74 and a compressive force of ring 50 exerted on neck 72. In one embodiment, ring 50 is made from a resilient, elastomeric material or stretchable polymeric material. An interior of cap 14 threadedly engages threaded neck 42 of mouth 40 to secure cap 14 in place over opening 43 and while an exterior of cap 14 to act as a base to contact support surface 11 (as shown in FIGS. 1 and 2A) to support container 20 in a generally vertically upright position (e.g., an upside-down orientation for a conventional pharmacy bottle).

FIGS. 3A-3D illustrate additional features of bottle 12, according to an embodiment of the invention.

Figure 3C:
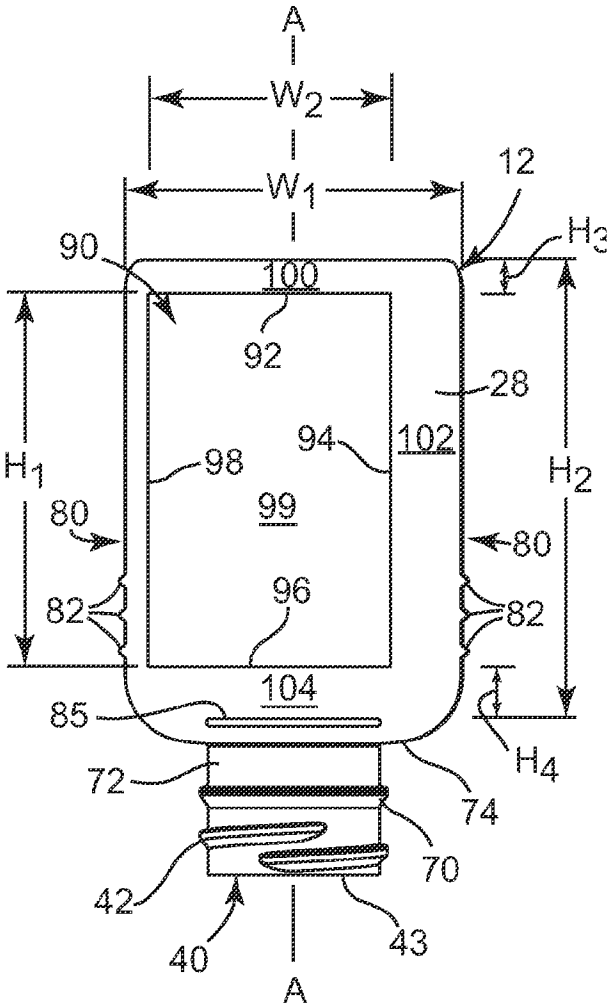
FIG. 3C is a plan view of a rear portion of a pharmacy bottle, according to an embodiment of the invention.
Figure 3B:
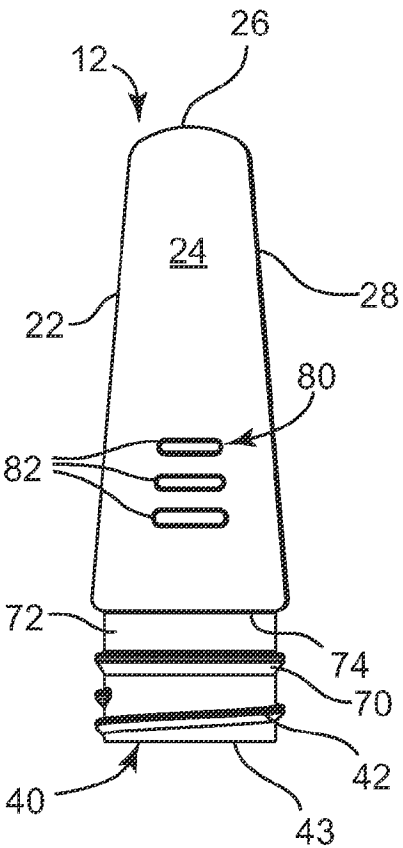
FIG. 3B is a plan view of a side portion of a pharmacy bottle, according to an embodiment of the invention.
Figure 3A:
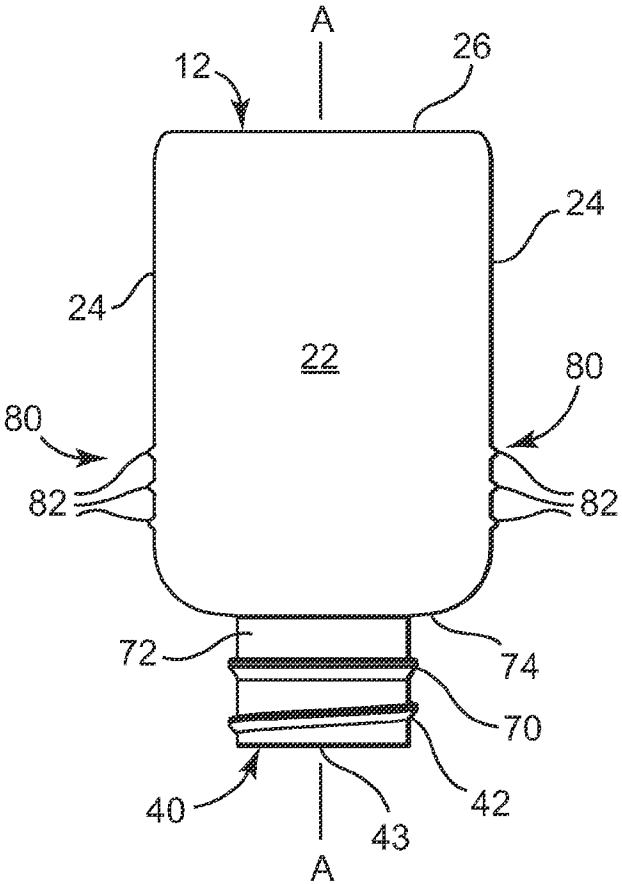
FIG. 3A is a plan view of a front portion of a pharmacy bottle, according to an embodiment of the invention.

As shown in FIGS. 3A-3C, front portion 22 of container 20 and back portion 28 of container 20 are opposite to, and spaced from each other while side portions 24 are opposite to, and spaced from each other. In addition, spine portion 26 and mouth 40 are opposite to, and spaced from each other.

As shown in FIGS. 3A-3C, in one embodiment bottle 12 further comprises array 80 of protrusions 82 on each side portion 24 located adjacent base portion 25B of side portions 24. Each protrusion 82, and the entire protrusion array 80, are not limited to the geometrical configuration and shapes shown in FIG. 3B (e.g., a vertically stacked group of linear ridges), and can comprise other shapes (e.g., protrusions that are round, triangular, square, etc.) and other grouped configurations (e.g., cross pattern, concentric circle, irregular patterns, etc.). In another embodiment, other embodiments such as pharmacy bottle 12 shown in FIGS. 1-2A include protrusion array 80 in a manner substantially the same as in FIGS. 3A-3C.

Figure 3D:
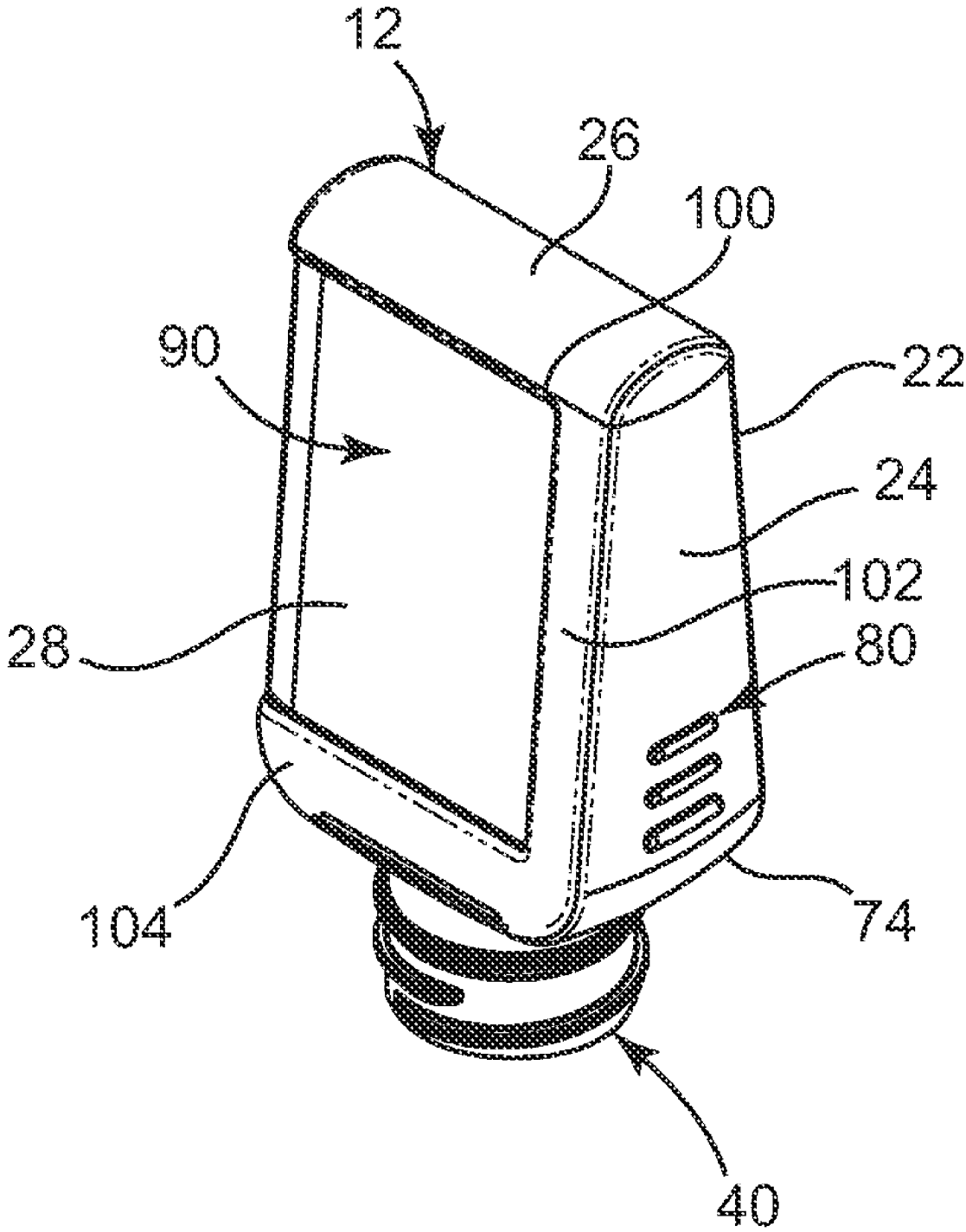
FIG. 3D is an isometric view of a pharmacy bottle, according to an embodiment of the invention.

FIG. 3C is a plan view of a back portion 28 of container 20, and illustrates additional aspects of recess 90 and back portion 28. FIG. 3D is an isometric view further illustrating the features and attributes described in association with FIGS. 3A-3C.

As shown in FIG. 3C, recess 90 comprises upper edge 92, inner edge 94, lower edge 96, outer edge 98, and recess surface 99. Edges 92 and 94 define upper and lower boundaries of recess 90 while inner edge 94 defines a lateral boundary of recess 90. Accordingly, recess 90 extends only partially laterally across a width of back portion 28 of container 20, terminating at inner edge 94. Outer edge 98 joins with an outer side of side portion 24 to partially form an opening of slot 69 (when label 60 is present). As further shown in FIG. 3C, back portion 28 includes upper contact portion 100, side contact portion 102, and lower contact portion 104 which together surround recess 90. Portions 100,102, and/or 104 define a single or separate contact surfaces for adhesively securing back portion 66 of label 60 to back portion 28 of container 20, thereby enabling extension of a portion of back portion 66 of label 60 over recess 90 to form slot 69 in bottle 12. As illustrated with reference to FIGS. 2B, 3A and 3C, in one embodiment, front portion 22 is characterized by an absence of any recess (e.g., an absence of a recess similar to recess 90 of back portion 28).

In one embodiment, back portion 28 of container 20 also comprises lip 85, which forms a protrusion on bottom portion 104 of back portion 28. Lip 85 enables precise placement of label 60 so that label 60 is properly aligned on back portion 28, particularly to enable placement of a non-stick portion of label 60 over recess 90, as will be further described in association with FIGS. 6-7.

Inner edge 94 of recess 90 prevents further sliding movement of an information card 68 laterally inward through slot 69, thereby helping to removably secure information card 68 in slot 69. This arrangement also causes the outer side of card 68 to protrude slightly outward from slot 69 (when card 68 is properly sized).

As shown in FIG. 3C, upper edge 92 and lower edge 96 of recess 90 define guides to help maintain lateral motion of information card 68 in and out of slot 69, and to maintain information card 68 within slot 69. In one embodiment, a distance between a back of back portion 66 of label 60 (e.g., non-stick portion 296 in FIG. 7), and recess 99, is selected to be large enough to enable slidable movement of information card 68 within slot 69, but snug enough to help retain information card 68 via frictional engagement and/or simple surface contact.

FIG. 4 is a plan view of a bottle 12 with a label 60 partially applied to container 20, according to an embodiment of the invention. FIG. 4 schematically illustrates placement of a single piece label 60 onto a container 20. In this example, back portion 66 of label 60 is adhesively secured to back portion 28 of container 20, and then label 60 is wrapped around container 20 by guiding spine portion 65 of label 60 onto spine portion 26 of container 20 (FIG. 3B) and front portion 64 of label 60 onto front portion 22 of container 20 for adhesive securing thereon. One feature of a single piece wrap-around label 60 is that any text on back portion 66 of label 60 is oriented at a 180 degree angle relative to text or images on front portion 64 of label 60. This reverse orientation or upside-down orientation of text of front portion 64 relative to back portion 66 enables the wrap-around application of label 60 to be secured onto two different opposite surfaces, each surface facing 180 degrees relative to each other.

FIG. 4 also further illustrates differentiation of different types of information on label 60 to enhance patient readability of label 60. As shown in FIG. 4, front portion 64 of label 60 comprises patient identifier 132, drug identifier 140, dose identifier 142, usage identifier 144, prescription data 146, and vendor data 148. In one embodiment, patient identifier 132 and drug identifier 140 are printed in a bold, large font positioned near a top portion of front portion 64 of label 60 so that they will appear adjacent a top region of front portion 28 of container 20, substantially as shown in FIGS. 1-2A. In one embodiment, dose identifier 142 and usage identifier 144 are positioned below patient identifier 132 and drug identifier 140 in a plain font (i.e., not bolded) of a smaller size than the font of patient identifier 132 and drug identifier 140. Other information which is of less immediate concern to the patient is positioned adjacent a bottom area of front portion 64 of label 60, such as prescription data 146 (e.g., physician name, expiration date, refills, etc) and/or vendor data 148 (e.g., name/address of retail pharmacy), which are also printed in smaller, plain font (as additionally shown in FIG. 2A). In one embodiment, front portion 64 of label 60 comprises primary information printed at the top region (e.g. drug identifier 140, and patient identifier 132) and secondary information at bottom region (e.g. vendor data).

Figure 8:
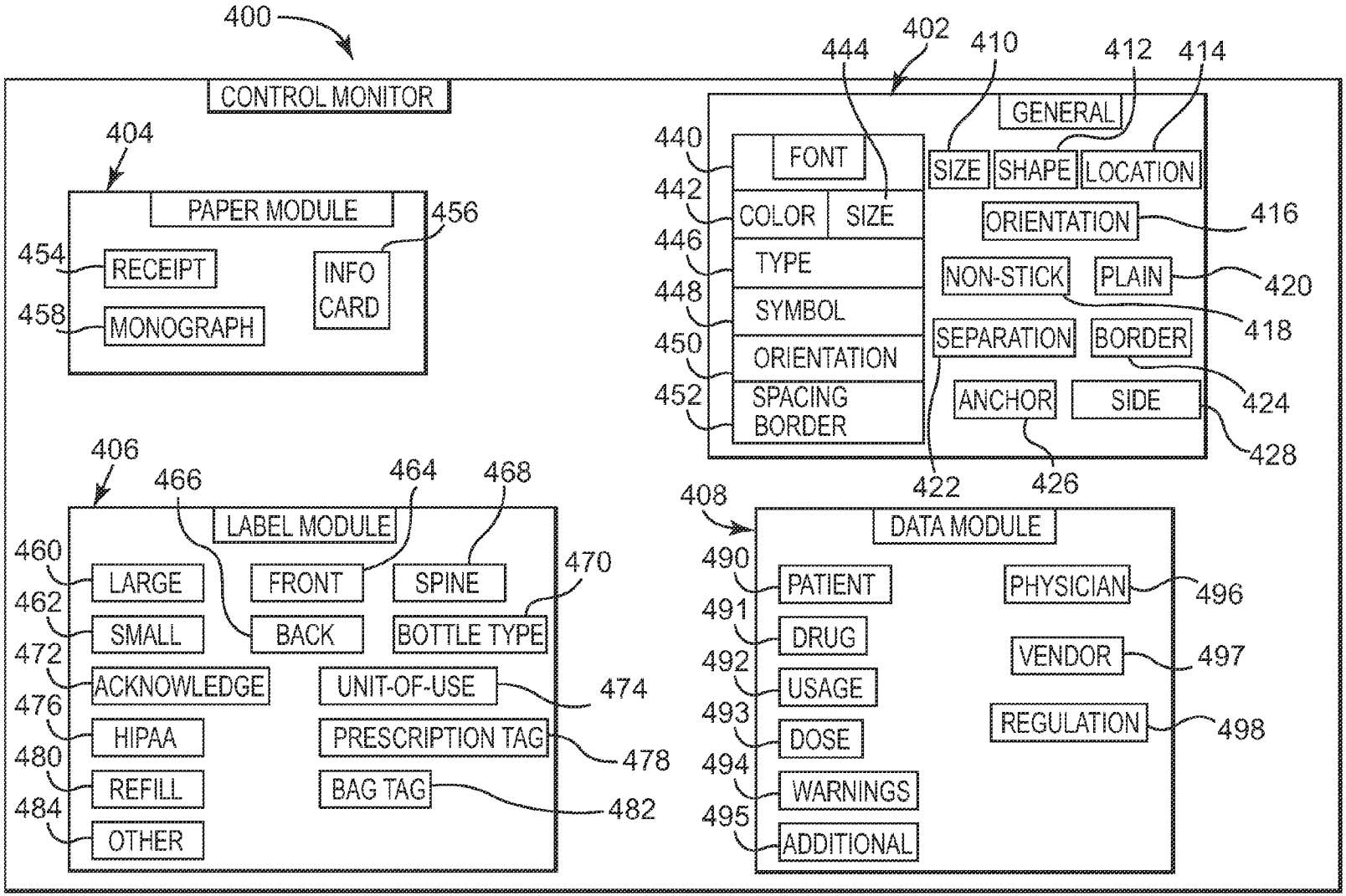
FIG. 8 is a block diagram of a control monitor of a prescription label system, according to an embodiment of the invention.

The positioning of different types of information and types of text and font on label 60 can be modified and/or selected via control monitor 400, as further described in association with FIG. 8.

As shown in FIG. 4, rear portion 66 of label 60 comprises caution header 118, warning one 120, warning two 122, and warning three 124. These warnings typically relate to dangers associated with side effects such as dizziness, confusion, drowsiness, etc. as well as concerns relating to consuming certain foods or alcohol while taking a medication. In one embodiment, one or more warnings include a symbol 125 (e.g., sign, pictogram, letter, etc) to provide a non-text indicator of the nature of the warning adjacent symbol 125. Substantially similar warnings and symbols are also illustrated in FIG. 1.

Spine portion 65 of label 60 comprises drug identifier 130 and/or patient identifier. In one embodiment, identifier 130 is in bold, large font letters to enhance quick identification of one bottle 12 relative to other bottles 12.

In one embodiment, front portion 64 has a height (H4) generally equal to a height (H6). Spine portion 65 has a height (H5). In one embodiment, height H4 and height H6 are substantially equal to each other and height (H5) is substantially less than height H4 or H6. Label 60 has a width (W3) that is generally equal to a width of front portion 22 and/or back portion 28 of container 20.

Figure 5B:
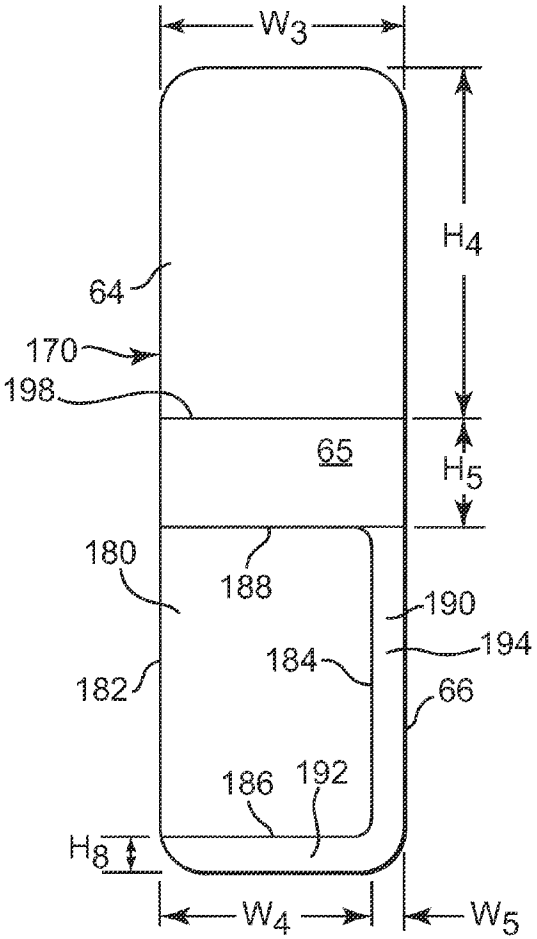
FIG. 5B is a plan view of a pharmacy bottle label, according to an embodiment of the invention.
Figure 5A:
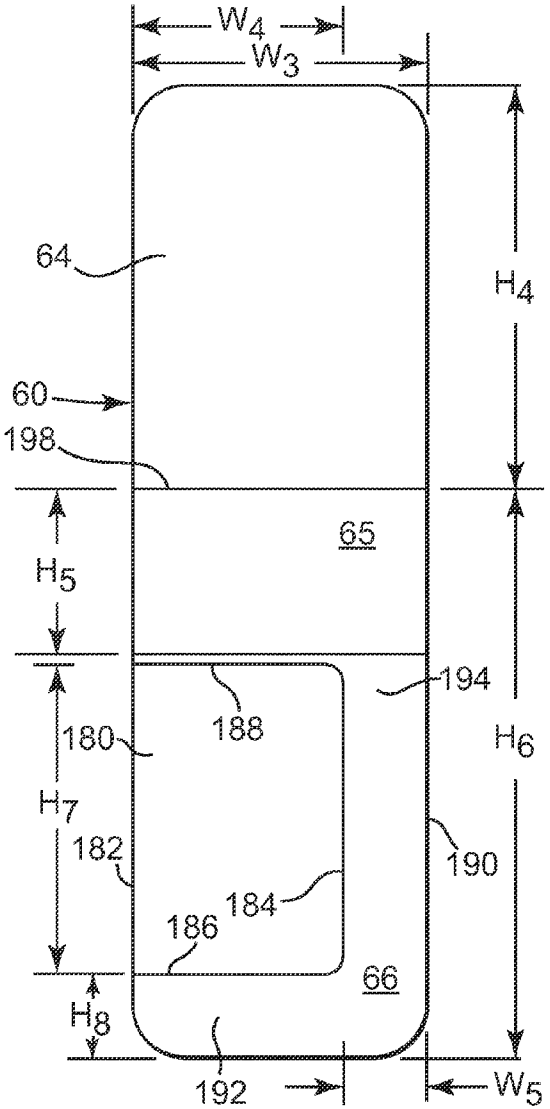
FIG. 5A is a plan view of a pharmacy bottle label, according to an embodiment of the invention.

FIGS. 5A and 5B are plan views which illustrate additional aspects of label 60 and label 170 (e.g., a smaller version of label 60), according to an embodiment of the invention. As shown in FIG. 5A, label 60 comprises a printed surface having an adhesive backing except for non-stick portion 180 (shown in dashed lines). Non-stick portion 180 includes outer edge 182, inner edge 184, lower edge 186, and upper edge 188. Edge 190 of back portion 66 of label 60 designates an edge at an opposite side of outer edge 182 of non-stick portion 180. In one embodiment, non-stick portion 180 has a width (W4) that extends laterally across a majority of the width (W3) of back portion 66 of label 60 to create sufficient lateral depth to form slot 69 (FIG. 1) for receiving information card 68. At the same time, this width (W4) of non-stick portion 180 enables side adhesive portion 194, of back portion 66 of label 60, to provide adhesive attachment of back portion 66 of label 60 to side portion 102 of back portion 28 of container 20 (FIG. 3C). Bottom adhesive portion 192 of back portion 66 of label 60 is also sized and shaped (having a height H8) for adhesive attachment to bottom portion 104 of back portion 28 of container 20 (FIG. 3C).

Non-stick portion 180 extends vertically across a majority of the height of back portion 66 (having a height H7) to create sufficient vertical space for slot 69 (FIG. 1) for receiving information card 68.

In one embodiment, label 60 is sized and shaped for larger pharmacy bottles, such as 30 dram and 60 dram bottles, while label 170 is sized and shaped for smaller pharmacy bottles, such as 15 dram. Accordingly, label 170 comprises substantially the same attributes and features of label 60, except being proportionally smaller to accommodate a smaller bottle size.

In one embodiment, label 60 includes a separation line 198 (also later identified as line 285 in FIG. 6) to enable separation of front portion 64 of label 60 from back portion 66 and spine portion 65 of label 60 to enable placement of label 60 on a 60 dram pharmacy bottle in a split arrangement. In this embodiment, front portion 64 of label 60, once separated from back portion 66 and spine portion 65, is placed on a front portion of a large pharmacy bottle and back portion 66 and spine portion 65 are placed on a back portion of the large pharmacy bottle, as will be described further in association with FIGS. 9A-9C.

Figure 6:
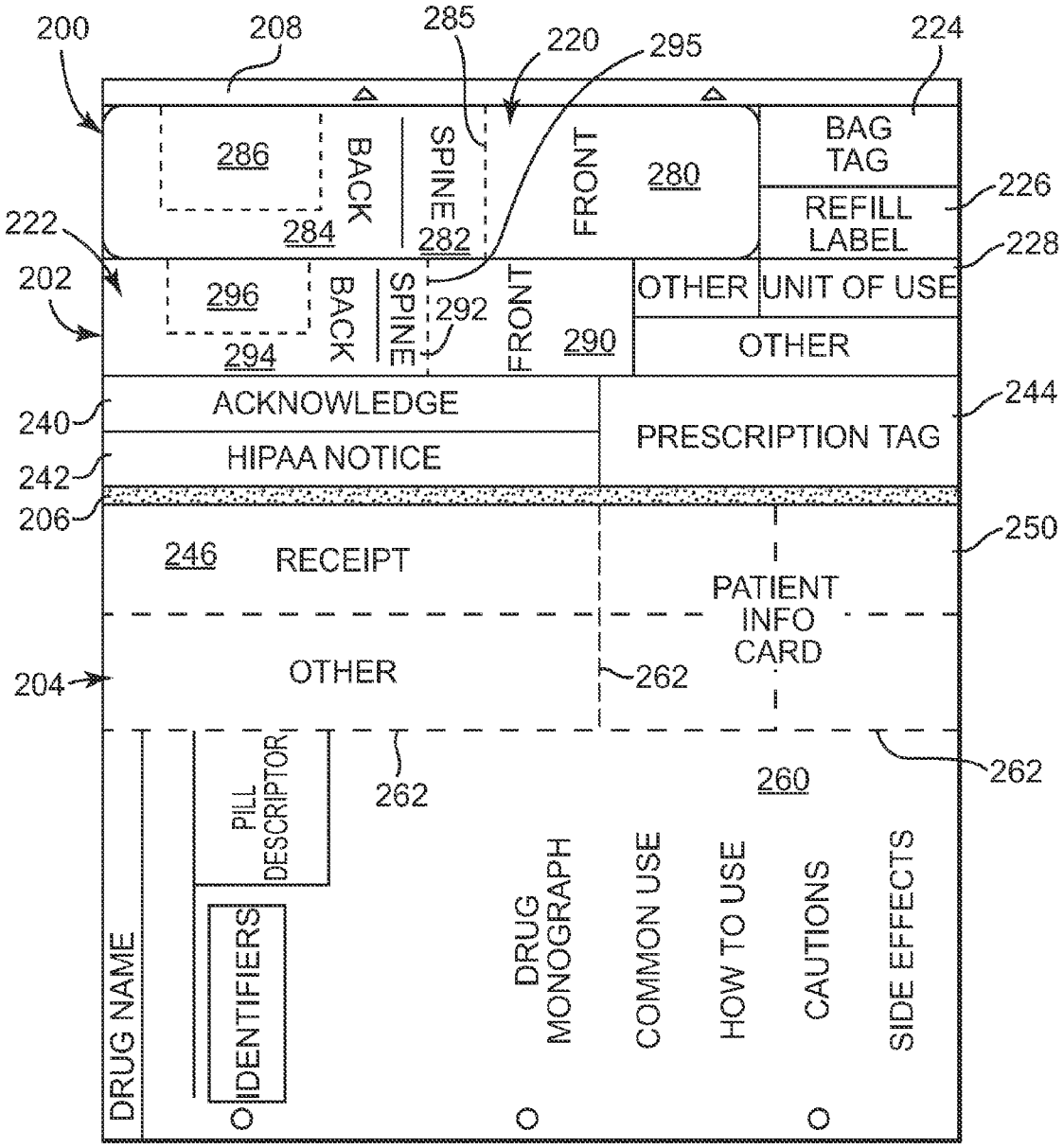
FIG. 6 is plan view of a pharmacy label system, according to an embodiment of the invention.

FIG. 6 is a plan view of a label system 200, according to an embodiment of the invention. As shown in FIG. 6, label system 200 comprises adhesive label sheet 202 and paper sheet 204 joined via anchor mechanism 206. Label system 200 is stocked as a blank sheet and insertable into a printer via insertion edge 208 to enable printing of prescription information onto label sheet 202 and paper sheet 204. Label sheet 202 is an adhesive label suited for receiving printing on its face and having an adhesive backing that is releasably secured to a non-stick sheet while paper sheet 204 is a conventional paper sheet suitable for printing information thereon.

Paper sheet 204 comprises receipt 246, patient information card 250, and drug monograph 260 (or other detailed synopsis) divided by separable seams 262 to enable separation of receipt 246, patient information card 250, and drug monograph 260 from each other. In one embodiment, patient information card 250 corresponds to patient information card 68 (e.g., FIGS. 1 and 2A).

Label sheet 202 comprises first bottle label 220, second bottle label 222, bag tag 224, refill label 226, unit-of-use label 228, acknowledgement label 240, HIPPA label 242, and prescription tag 244.

In one embodiment, first bottle label 220 and second bottle label 222 have substantially the same features and attributes as label 60 and label 170 as described in association with FIGS. 1-5B. In another embodiment, label 220 and 222 have features and attributes determined by control monitor 400, as described in association with FIG. 8.

As shown in FIG. 6, first bottle label 220 is sized and shaped for larger and medium sized bottles, such as 60 dram and 30 dram bottles. First bottle label 220 comprises front portion 280, spine portion 282, back portion 284 including non-stick portion 286. These components are described in greater detail in association with FIG. 7. In one embodiment, a separation line 285 enables separation of front portion 280 relative to back portion 284 and spine portion 282 for application of front portion 280 to a front portion of a bottle separate from application of back portion 284 (and spine portion 282) on a back portion of a bottle. In one embodiment, front portion 280, spine portion 282, and back portion 284 of label 220 correspond directly to front portion 64, spine portion 65, and back portion 66 of label 60, as previously described and illustrated in association with FIGS. 1-5B.

Second bottle label 222 is sized and shaped for smaller-sized bottles, such as a 15 dram bottle. Second bottle label 222 comprises front portion 290, spine portion 292, and back portion 294 including non-stick portion 296. These components are described in greater detail in association with FIG. 7. In one embodiment, a separation line 295 enables separation of front portion 290 relative to back portion 294 and spine portion 292 for application of front portion 290 to a front portion of a bottle separate from application of back portion 294 (and spine portion 292) onto a back portion of a bottle. In one embodiment, front portion 290, spine portion 292, and back portion 294 of label 222 correspond directly to front portion 64, spine portion 65, and back portion 66 of label 60 and label 170, as previously described and illustrated in association with FIGS. 1-5B.

Bag tag label 224 includes retail-sorting information and is removable for adhesive placement on a retail bag for identifying the bag with a particular patient and prescription. Refill label 226 includes retail information relating to processing refill prescriptions. Unit-of-use label 228 is sized and shaped for application to smaller single dose packaging, such as liquid vials, eye droppers, etc., and includes basic prescription information (e.g., patient, drug name, and dose) and/or usage instructions, but is not limited to those types of information.

Acknowledgement label 240 comprises a mechanism for the patient to acknowledge receipt of the drug and/or confirmation of instructions on how to take the drug. HIPAA label 242 comprises a notice to the patient, which the patient countersigns, regarding confidentiality and sharing of patient information. Prescription tag 244 is a label used in-house by the pharmacist or technician for handling the prescription.

In use, a pharmacist or technician enters or recalls patient and prescription information into a control module (via a graphical user interface) and then directs printing of that information onto label system 200. The various labels and information sheets/cards are separated from each other and/or removed from label system 200 for placement on bottles, bags, etc, or used for internal retail purposes. Accordingly, label system 200 enables generating a comprehensive set of information to fill and deliver a prescription to a consumer in an efficient, highly readable and organized manner, thereby improving consumer use of the prescription and retail delivery.

Figure 7:
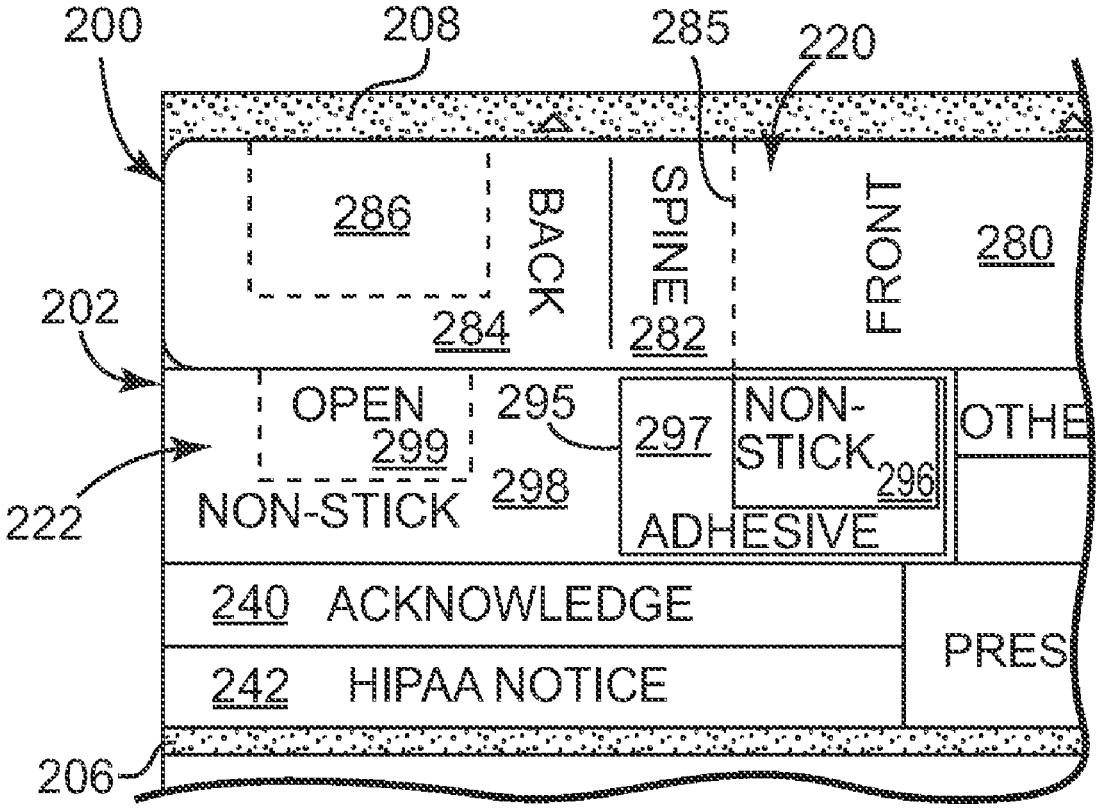
FIG. 7 is partial plan view of a pharmacy label system, according to an embodiment of the invention.

FIG. 7 is a partial view of FIG. 6, schematically illustrating back portion 294 of label 222 folded over on top of front portion 290 of label 222 at separation line 295 as back portion 294 and spine portion 295 have been releasably removed from the non-stick sheet underlying label 222. As shown in FIG. 7, this maneuver reveals non-stick backing portion 298 and open portion 299, which directly corresponds in size, shape, orientation, and placement of non-stick portion 296 (shown in phantom in FIG. 6) of label 222. As further shown in FIG. 7, the back side of label 222 comprises non-stick portion 296 and adhesive portion 297. Adhesive portion 297 directly corresponds in size, shape, orientation, and placement of non-stick portion 298 of the backing sheet. Non-stick portion 296 of label 222 corresponds to the portion of a label (e.g., label 60) that extends over a recess on a back portion of a pharmacy bottle to form a slot for removably receiving a patient information card, as previously described and illustrated in association with FIGS. 5A-5B. In one embodiment, non-stick portion 296 of label 22 extends only partially across a width of back portion 294 of label 22. In another embodiment, non-stick portion 296 of label 22 extends across the entire width of back portion 294 of label 222.

FIG. 8 is a block diagram of a control monitor 400, according to an embodiment of the invention, that is viewable and operable via a user interface of a computer system (not shown) for controlling printing of label system 200 (shown in FIG. 6) including what types of information are printed, how the information is organized, etc. as expressed through selectable parameters of control monitor 400. Accordingly, control monitor 400 enables a pharmacist or other operator to customize label system 200 (shown in FIGS. 6-7) to meet changing regulations, retail practices, and consumer preferences. In one embodiment, parameters of control monitor 400 can be applied to affect one or more other parameters of control monitor 400 on a parameter-by-parameter basis, or by groups of parameters, at the discretion of the operator of control monitor 400, as applicable based on the type of parameter being applied or controlled. In another embodiment, parameters of control monitor 400 can be applied to affect one or more labels, sheets, or portions of a label or sheet on an label-by-label basis, on a sheet-by-sheet basis or by groups of labels and/or sheets, at the discretion of the operator of control monitor 400.

As shown in FIG. 8, control monitor 400 comprises general module 402, plain paper module 404, label module 406, and data module 408. Control monitor 400 also represents a memory in which control monitor 400 is stored for use with a computer system, and control monitor 400 includes but is not limited to software, hardware, firmware, and other known forms of electronic memory.

General module 402 comprises size parameter 410, shape parameter 412, location parameter 414, orientation parameter 416, non-stick parameter 418, plain parameter 420, separation parameter 422, border parameter 424, anchor parameter 426, and side parameter 428. General module 402 also comprises font module 440, which includes color parameter 442, size parameter 444, type parameter 446, symbol parameter 448, orientation parameter 450, and spacing/border parameter 452.

General module 402 controls general aspects of label system 200 as a whole or as individual portions of label system 200. In one embodiment, one or more of these parameters such as size, shape, orientation of labels, and other general parameters can be pre-programmed or selected for a particular state or region, so that a pharmacist or technician need not select those parameters each time that a prescription is filled.

Size parameter 410 and shape parameter 412 separately control the size and shape, respectively, of a label or other portion (e.g., sheet, card, anchor, non-stick portion, etc.) of a label system, such as label system 200. Location parameter 414 and orientation parameter 416 separately control the location and orientation, respectively, of a label or other portion (e.g., sheet, card, anchor, non-stick portion, etc.) of a label system, such as label system 200.

Non-stick portion 418 and plain parameter 420 separately control which portions of label system 200 will be non-stick portions (e.g., non-stick portion 296 in FIG. 7) of an adhesively backed label or region (e.g., adhesive portion 297 of label 222 of FIG. 7) and which portions of label system 200 will be plain paper portions (e.g., monograph 260 in FIG. 6), respectively, relative to adhesive label portions of label system 200.

Separation parameter 422 and border parameter 424 separately control creation of separation lines and borders, respectively, between adjacent labels or other adjacent portions (e.g., sheet, card, anchor, non-stick portion, etc.) of a label system, such as label system 200. Anchor parameter 426 controls the creation, location, and the nature of anchor points or seams (e.g., anchor mechanism 206 in FIG. 6) between adjacent portions (e.g. label sheet 202 and paper sheet 204) of a label system, such as label system 200. Side parameter 416 controls whether or not printing of information occurs on one or both sides of a label or paper sheet of a label system 200.

As shown in FIG. 8, general module 402 also comprises font module 440, which includes color parameter 442, size parameter 444, type parameter 446, symbol parameter 448, orientation parameter 450, and spacing/border parameter 452. Font module 440 controls various aspects of printing on a label system via, but not limited to, the following parameters. Color parameter 442, size parameter 444, type parameter 446, and symbol parameter 448 separately control the color, size, type of font, and symbols, respectively, of any printed matter on a label system, such as label system 200. Orientation parameter 450 controls the orientation (e.g., vertical, horizontal, angled, upside down, right side up, etc.) of any printed matter on a label system, such as label system 200. Spacing/border parameter 452 controls the spacing and/or borders between adjacent portions of printed matter to enhance patient differentiation between different types of information on a label system, such as label system 200.

As shown in FIG. 8, paper module 404 comprises receipt parameter 454, information card parameter 456, and monograph parameter 458. Paper module 404 controls printing matter on plain paper sheets that form portions of a label system, such as paper portion 204 of label system 200 of FIG. 6. Paper module 404 can activate or deactivate inclusion of plain paper sheets as part of label system 200. Receipt parameter 454 of plain module 404 controls selective inclusion of a receipt as part of label system 200. Information card parameter 456 controls selective inclusion of an information card, such as patient information card 68 (FIG. 1), as part of a label system 200 generated via control monitor 400. Monograph parameter 458 controls selective inclusion of a monograph or other patient information sheet, such as sheet 260 (FIG. 4), as part of a label system generated via control monitor 400.

Upon activation of one or more parameters of paper module 404, various aspects of printed matter, including its content and appearance, are further customizable or controllable via data module 408 and/or general module 402.

Label module 406 of control monitor 400 comprises large parameter 460, small parameter 462, front parameter 464, back parameter 466, spine parameter 468, and bottle-type parameter 470. Label module 406 also comprises acknowledgement parameter 472, unit-of-use parameter 474, notice parameter 476, prescription info parameter 478, refill parameter 480, bag-tag parameter 482, and other parameter 484.

Large parameter 460, small parameter 462, separately control pre-programmed parameters for large label sets and for small label sets, such as large bottle label 220 and small bottle label 222 of label system 200 (FIG. 6), respectively. Front parameter 464, back parameter 466, and spine parameter 468, control various aspects (e.g., inclusion, relative sizing and shapes, etc.) of a front portion, back portion, and spine portion of a label, such as label 220 or label 222 of label system of FIG. 6. Bottle-type parameter 470 controls generating labels to fit a particular type of bottle upon selection of the bottle type by the operator, via cooperation with other parameters of label module 406 and via cooperation with general module 402. In one embodiment, bottle-type parameter 470 enables pre-selection of an entire family of parameters in label module 406 and general module 402 of control monitor 400 to generate a label system, such as label system 200, suited for a respective type of bottle, including but not limited to, a first type of bottle (e.g., bottle 12 in FIGS. 1-3D), a second type of bottle (e.g., bottle 500 in FIGS. 9A-9C), and a third type of bottle (e.g., bottles 600,700 in FIGS. 10-13C).

Data module 408 of control monitor 400 controls which data, and where and how that data is expressed as printed matter on a label system for a bottle. Data module 408 enables control over entry, storage, retrieval, and display of this data for use in manipulating parameters of various modules, including data module 408, of control monitor 400. As shown in FIG. 8, data module 408 comprises patient parameter 490, drug parameter 491, usage parameter 492, dose parameter 493, warning parameter 494, additional parameter 495, physician parameter 496, vendor parameter 497, and regulation parameter 498.

Patient parameter 490 of data module 408 controls patient data such as name, address, phone, identification number(s), etc. while drug parameter 491 controls drug data such as drug name, drug supplier, etc. Usage parameter 492 controls data relating to proper usage of a drug while dose parameter 492 controls data relating to the prescribed dose of a drug. Warning parameter 494 controls data relating to cautions and warnings associated with a drug or other interacting substance/liquid. Additional parameter 495 enables an operator of control monitor 400 to add additional relevant data to a label or label system, on a case-by-case basis.

As shown in FIG. 8, physician parameter 496 of data module 408 controls data relating to physician name, physician address, etc., while vendor parameter 497 controls data relating to the name, location, phone, and logo (or other marketing aspect) of a vendor that dispenses the drug in one of their retail locations (e.g. pharmacy department of a Target® store). Regulation parameter 498 shapes which data is used and how it is used on a label generated by control monitor 400 by designating, incorporating, and/or applying local, county, state, and/or federal regulations in the manner of using or displaying data on a pharmaceutical bottle, label, packaging, etc.

Accordingly, control monitor 400 enables generating a label system, including an entire family of labels, sheets, and other types of printed matter for placement on and use with pharmacy bottles, as described and illustrated throughout this application.

Figure 9C:
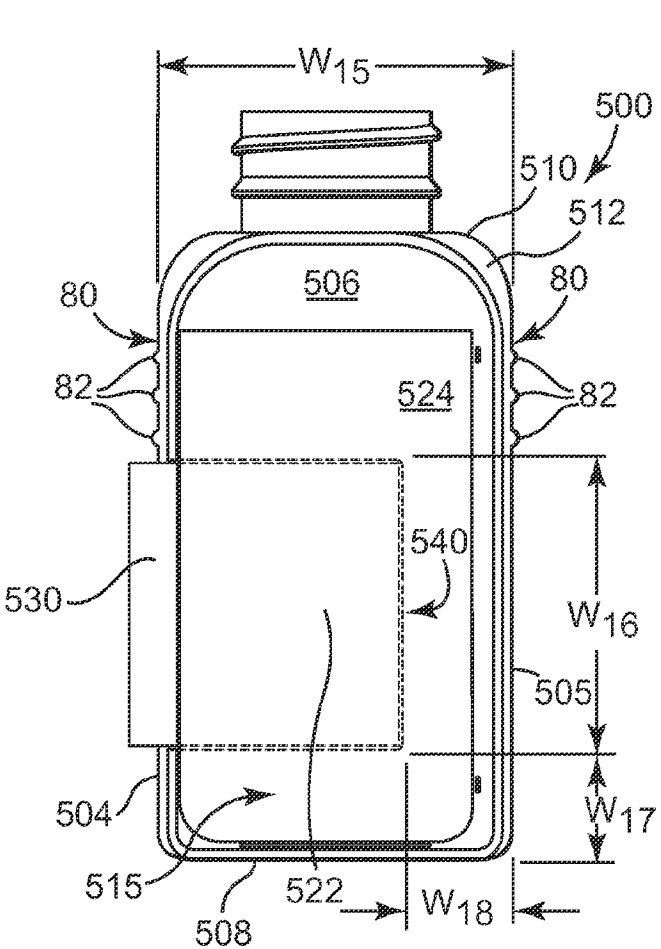
FIG. 9C is a plan view of a rear portion of a pharmacy bottle, according to an embodiment of the invention.
Figure 9B:
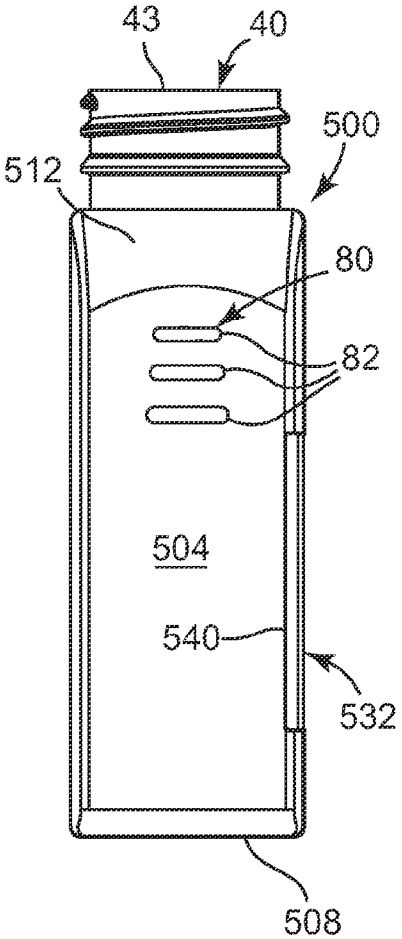
FIG. 9B is a plan view of a side portion of a pharmacy bottle, according to an embodiment of the invention.
Figure 9A:
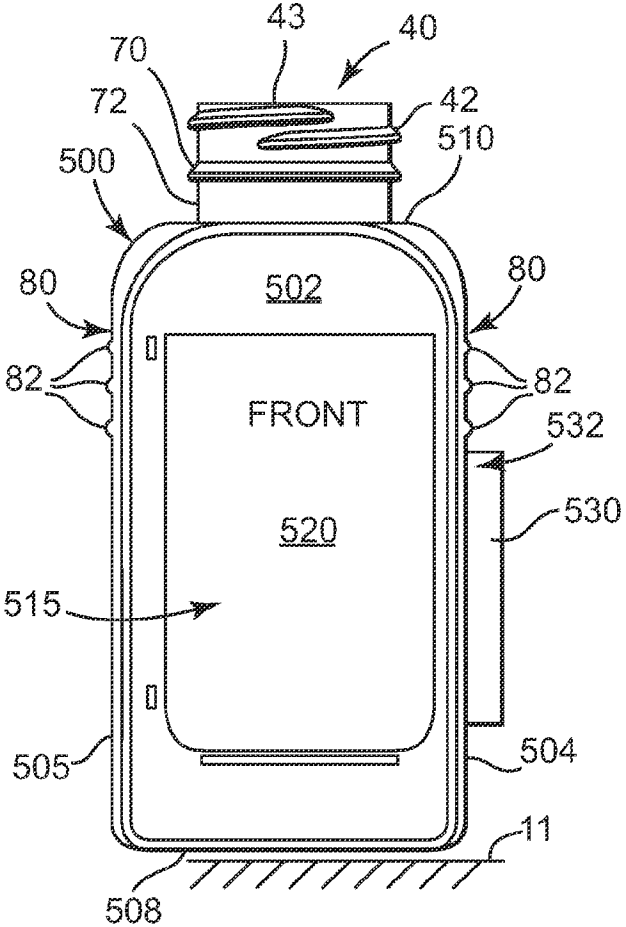
FIG. 9A is a plan view of a front portion of a pharmacy bottle, according to an embodiment of the invention.

FIGS. 9A-9C comprise plan views of a pharmacy bottle 500, according to an embodiment of the invention. As shown in FIG. 9A, pharmacy bottle 500 comprises front portion 502, side portion 504, back portion 506, bottom portion 508 and top portion 510 with shoulder 512. Front portion 502, side portions 504, and back portion 506 each define a generally rectangularly shaped surface and a generally planar surface. Pharmacy bottle 500 also comprises mouth 40 with opening 43 and threaded neck 42, as well as collar 70 and neck space 72. In one embodiment, pharmacy bottle 500 comprises protrusion array 80 on one or both side portions 504. In another embodiment, pharmacy bottle 500 comprises side portions 504 without a protrusion array 80.

As shown in FIGS. 9A-9C, bottle 500 comprises slot 532 for removably receiving card 530, in a manner substantially the same as the interaction of slot 69 with patient information card 68 in previously described embodiments of the invention. Slot 532 is defined by recess 540 and back portion 522 of label 515.

Front portion 502 receives a front portion 520 of a label 515, while back portion 506 of bottle 500 receives a back portion 522 and spine portion 524 of label 515. Front portion 520, spine portion 524, and back portion 522 of label 515 comprises generally the same features and attributes of label 60, 170 as previously described and illustrated in association with FIGS. 1-5B. However, FIGS. 9A-9C further illustrate the separation of front portion 520 of label 515 from spine portion 524 and back portion 522 of label 515 to enable placement on the larger size bottle (60 dram) that has a different shape and right-side up orientation when a bottom portion 508 of bottle 12 is placed on a support surface 11.

Figure 10:
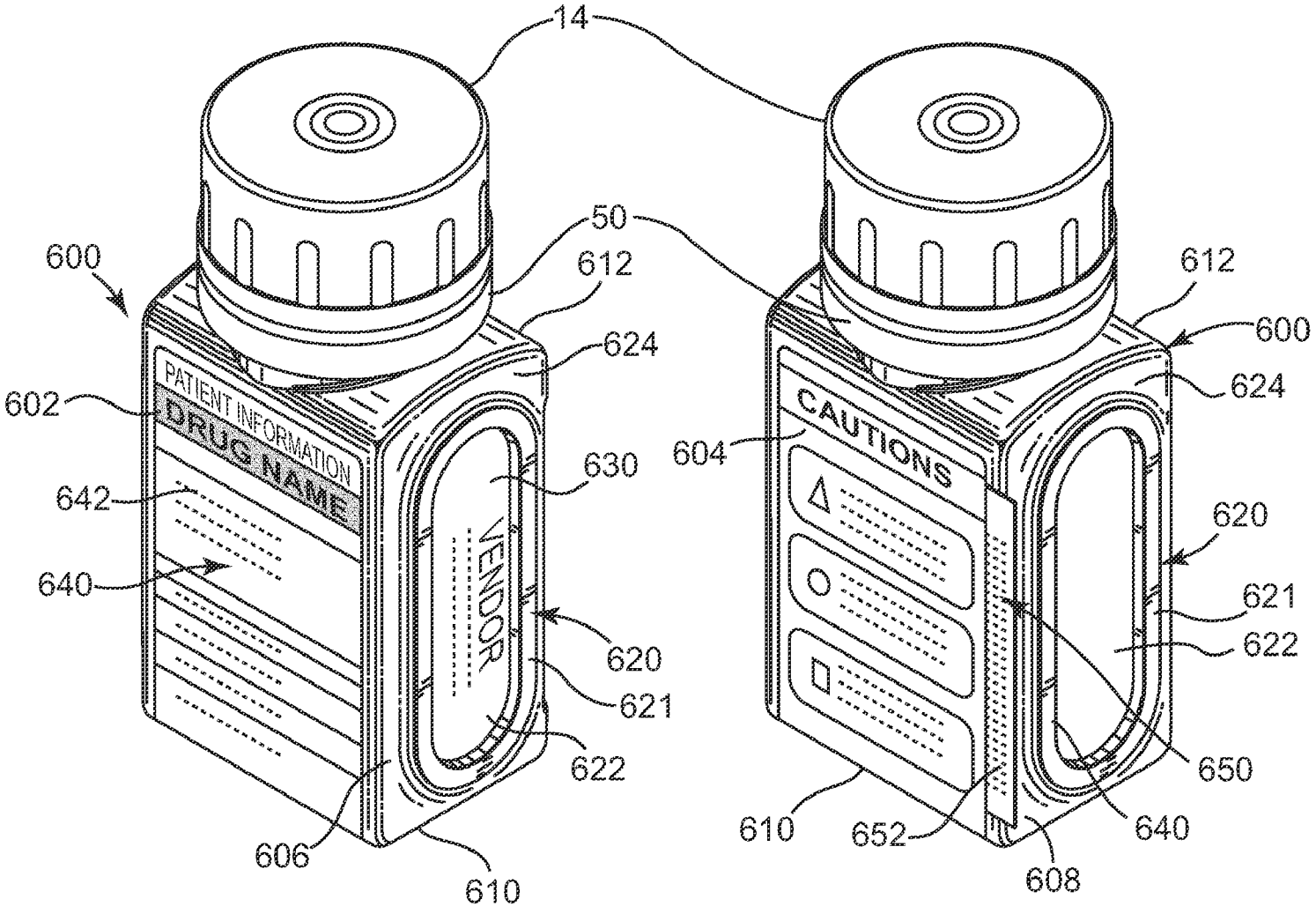
FIG. 10 is an isometric view of a plurality of pharmacy bottles, according to another embodiment of the invention.

FIG. 10 is an isometric view of pharmacy bottles 600, according to an embodiment of the invention, with the bottle 600 on the left primarily showing a front portion 602 and side portion 606 of bottle 600 and the bottle 600 on the right primarily showing a back portion 604 and side portion 608 of the bottle 600. Front portion 602, back portion 604, and side portions 606, 608 each define a generally rectangularly shaped surface, and with front portion 602 and back portion 604 also forming a generally planar surface. As shown in FIG. 10, pharmacy bottle 600 comprises a container also including a bottom portion 610, as well as cap 14 and/or ring 50, as previously described in association with FIGS. 1-4 and 9A-9C.

Label 640 on bottle 600 forms a slot 650 for removably receiving a patient information card 652, in a manner substantially the same as for the embodiments of FIGS. 1-3 and 9A-9C. In one embodiment, patient information card 640 corresponds to patient information card 250 of label system 200 (shown in FIG. 6). Formation of slot 650 is described in more detail in association with FIG. 11A.

As shown in FIG. 10, pharmacy bottle 600 comprises protrusion 620. In one embodiment, protrusion 620 comprises a ring 621 formed in an elongated, annular pattern and that is raised from a surface 624 of side portions 606, 608. Ring 621 defines a recessed surface 622. In one embodiment, recessed surface 622 receives a label 630 from label system 400 for placement within ring of protrusion 620. Locating a label, such as one bearing a vendor identifier, patient identifier, drug identifier, and/or physician identifier, within protrusion 620 makes display of the label 630 more prominent, drawing attention to the information recessed within the protrusion. In one embodiment, protrusion 620 also can be used to aid gripping bottle.

In other embodiments, protrusion 620 is not strictly limited to the elongated ring 620, but can include other shapes and configurations, such as a rectangular shaped protrusion, a circular shaped protrusion, an elliptical-shaped protrusion, a triangular-shaped protrusion, etc. Finally, in another embodiment, bottle 12 does not include protrusion 620 on side portions 606 and 608.

As shown in FIG. 10, label 640 comprises a front portion 642 adhesively secured to front portion 602 of bottle 600 and a back portion 644 adhesively secured to back portion 604 of bottle 600. Label 640 has substantially the same features and attributes of labels of label system 200 of FIG. 6. In one embodiment, label 640 is selected as label 222 from label system 200 in which front portion 290 of label 222 corresponds to front portion 642 of label 640 and back portion 294 and spine portion 295 of label 222 corresponds to back portion 644 of label 640. In one embodiment, label 222 is generated from control monitor 400 to omit spine portion 295 so that back portion 644 of label 640 corresponds only to back portion 294 of label 222 with spine portion 295 not defining an area interposed between back portion 294 and front portion 290 of label 222.

In addition, when label 640 is selected as the type of label 222 from label system 200 (FIG. 6), front portion 642 is separated from back portion 644 before application to bottle 600 via a separation line corresponding to separation line 295 of label 222 (FIG. 6). Accordingly, this embodiment further illustrates the ability of label 222 (or label 220) having a single printed configuration to be used in a split arrangement on one type of bottle, such as bottle 600 shown in FIG. 10, and to be used as a single piece label on a second type of bottle, such as bottle 12 in FIG. 4, in which the label 60 (corresponding to label 220, 222 from FIG. 6), is wrapped around the surfaces of bottle 12 while maintaining the entire label 222 as one piece.

Figure 11B:
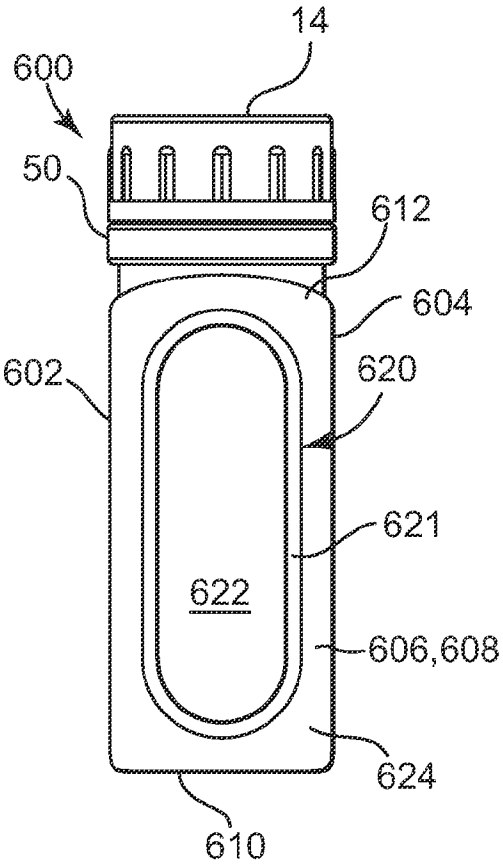
FIG. 11B is a plan view of a side portion of a pharmacy bottle, according to an embodiment of the invention.
Figure 11A:
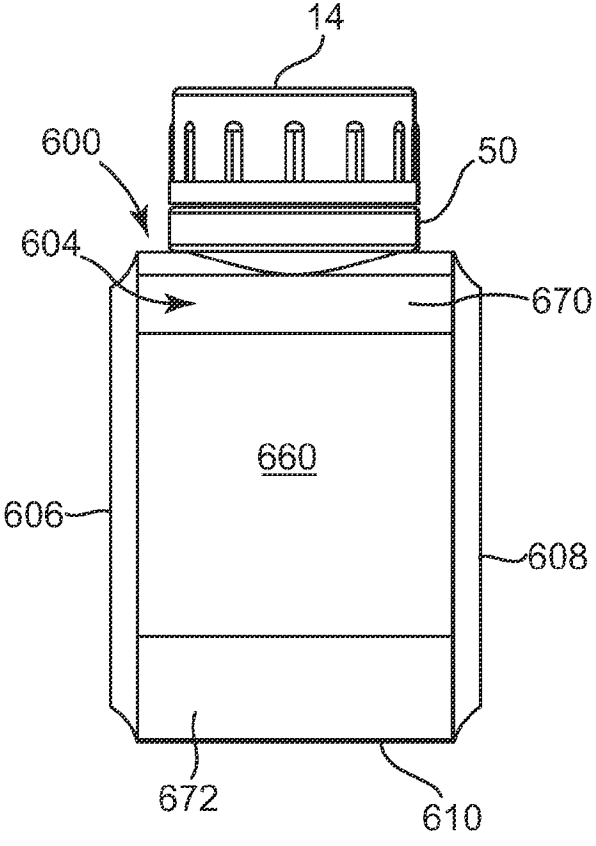
FIG. 11A is a plan view of a rear portion of a pharmacy bottle, according to an embodiment of the invention.

FIG. 11A is a plan view of a rear portion of bottle 600, according to an embodiment of the invention. As shown in FIG. 11A, rear portion 604 of bottle 600 comprises recess 660, upper contact portion 670, and lower contact portion 672. Upper contact portion 670 and lower contact portion 672 are disposed on opposites sides of, and surround, recess 660. Rear portion 604 is sized and shaped to receive adhesive attachment of a label, such as rear portion 284 of label system 200 (FIG. 4), onto upper contact portion 670 and lower contact portion 672 with the remainder of the rear portion of the label extending over recess 660 as further explained below. Recess 660 is formed as a depression in the surface of rear portion 604 to enable formation of slot 650 (shown in FIG. 10), in a manner substantially the same as for the formation of slots in the embodiments of FIGS. 1-3, and 9A-9C, to enable receipt of a patient information card 640. In one embodiment, as shown in FIG. 11A, recess 660 on rear portion 604 of bottle 600 extends laterally across the entire width of the face of rear portion 604. This feature enables the patient information card (e.g., patient information card 250 shown in FIG. 6 or patient card 68 in FIG. 1) to extend out either lateral side of the recess (left or right side of the bottle), thereby enabling greater flexibility in inserting and/or removing the patient information card relative to the slot (e.g. slot 650). In addition, this feature enables relatively larger patient information cards to be inserted into a slot with a full lateral width recess, since the patient information card can protrude out both sides of the slot, if necessary, to help accommodate the larger sized patient information card.

Figure 13C:
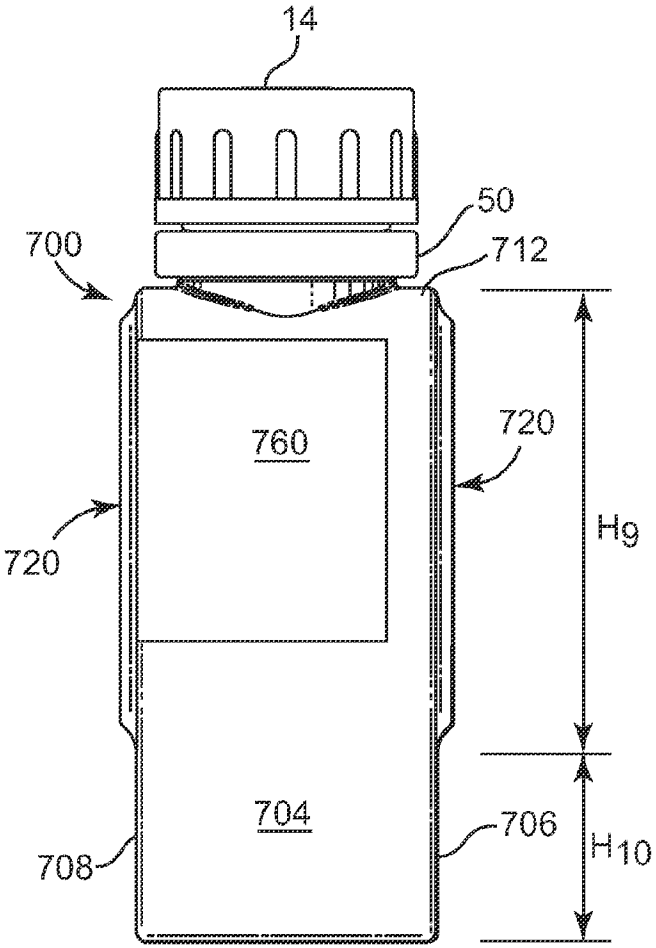
FIG. 13C is a plan view of a rear portion of a pharmacy bottle, according to an embodiment of the invention.
Figure 13B:
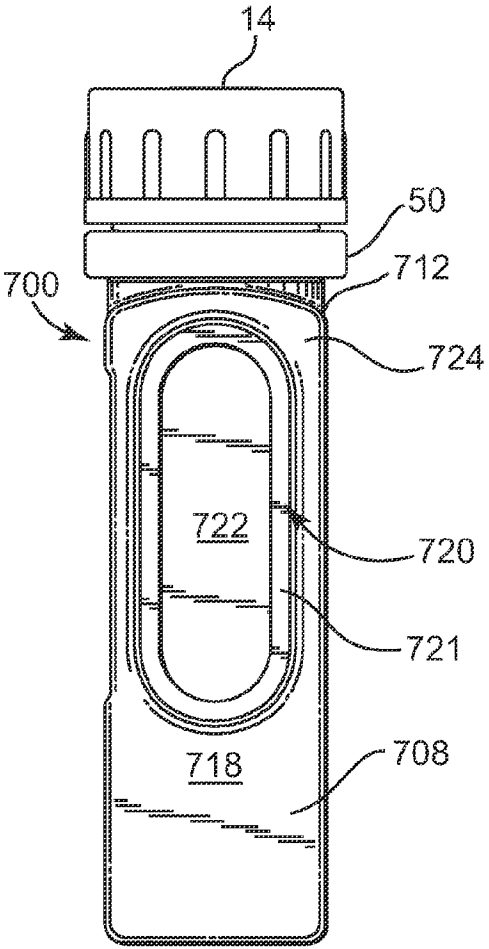
FIG. 13B is a plan view of a side portion of a pharmacy bottle, according to an embodiment of the invention.
Figure 13A:
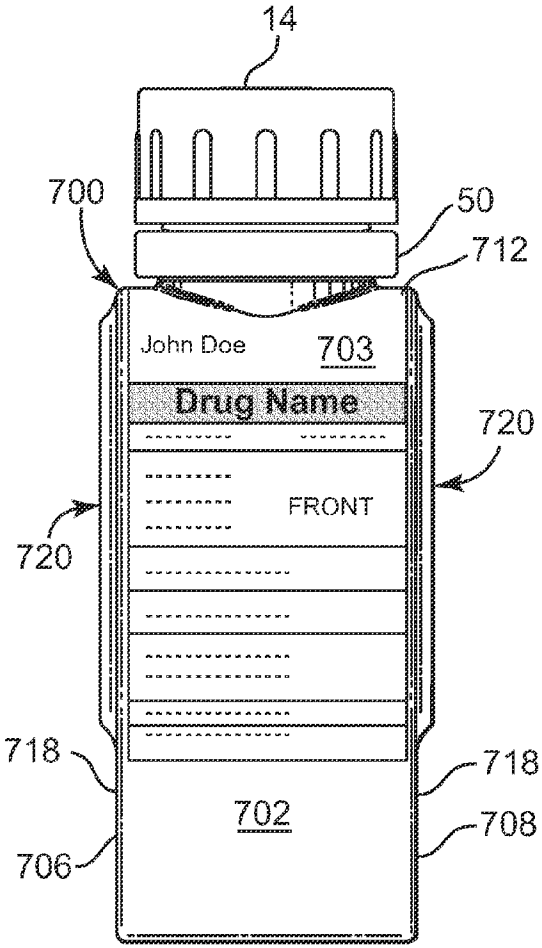
FIG. 13A is a plan view of a front portion of a pharmacy bottle, according to an embodiment of the invention.

Moreover, in other embodiments, a recess that extends laterally across the entire width of rear portion of a bottle (such as rear portion 604 of bottle 600) can be substituted for the recess in the embodiments of FIGS. 1-3D, FIGS. 9A-9C, and/or FIGS. 13A-13C which extends laterally only partially across the entire width of the rear portion of those respective embodiments.

In another embodiment, the recess 660 that extends laterally across the entire width of rear portion 604 of bottle 600 can be replaced with a recess, such as recess 90 (FIG. 3C), recess 760 (FIG. 13C) and other recesses, in the embodiments of FIGS. 1-3D, FIGS. 9A-9C, and/or FIGS. 13A-13C which extends laterally only partially across the entire width of the rear portion of those respective embodiments. Accordingly, in this embodiment of bottle 600, recess 660 would extend only partially across the face of rear portion 604.

FIG. 11B is plan view of one side of bottle 600, that represents either side portion 606 or side portion 608 (FIG. 10) of bottle 600, further illustrating protrusion 620 and surface 624. In one embodiment, side portions 606 and 608 are substantially the same as each other in size, shape, orientation, and overall configuration.

Figure 12:
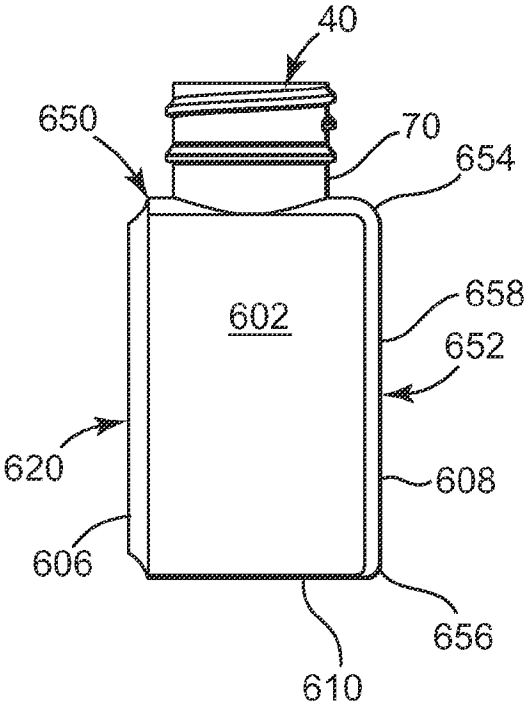
FIG. 12 is a plan view of a front portion of a pharmacy bottle, according to another embodiment of the invention.

In another embodiment, side portions 606 and 608 are dissimilar to each other. As shown in FIG. 12, one aspect of this embodiment includes side portion 606 including protrusion 620, substantially as shown in FIG. 11B, and side portion 608 including side portion 652 having a generally flat surface with curved edges, such as a curved upper edge 654, a curved lower edge 656, and a curved side edge 658.

FIGS. 13A-13C are plan views of a pharmacy bottle 700, according to an embodiment of the invention. As shown in FIGS. 13A-13C, bottle 700 comprises front portion 702, back portion 704, side portions 706 and 708, and top portion 712. Bottle 700 has substantially the same features and attributes as bottle 600, previously described in association with FIGS. 10-12, except for differences relating to a greater height of bottle 700 and the relative proportion of features on the front portion 702, back portion 704, and side portions 706, 708. In one aspect, recess 760 has substantially the same features and attributes of recesses previously described in association with FIGS. 1-3D and 9A-12 relating to formation of a slot (e.g., slot 650 in FIG. 10) in combination with a label, such as label 640 in FIG. 10, to enable slidable insertion and removal of a patient information card, such as patient information card 652 of FIG. 10 relative to the slot.

In one embodiment, each side portion 706,708 comprises a protrusion 720, including ring 721 and surface 722, and surface 718, having substantially the same features and attributes as side portions 620 of bottle 600 of the embodiment of FIG. 10, except for the difference ring 720 being relatively smaller in proportion to an increased surface 718 on side portions 706, 708 relative to a larger total surface area of surface 718 on bottle 700. In another embodiment, only one side portion of the two side portions 706, 708 comprises a protrusion 720.

In another embodiment, bottle 700 comprises no protrusions 720 on either one of side portions 706, 708.

Embodiments of the invention significantly enhance a patient's experience in becoming informed about a prescription directly from the prescription bottle and significantly enhance a retail pharmacy's ability to consistently fill and deliver the prescription in a manner that maintains the patient's satisfactory experiences with a pharmacy purchase.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A bottle comprising:

a container including:

a front portion, a back portion spaced from the front portion, the back portion generally facing away and in an opposite direction from the front portion, an opening positioned between the front portion and the back portion of the container to at least partially define a first end of the container, and a spine portion extending between the front portion and the back portion of the container to define a second end of the container opposite the first end; and a label extending over and in contact with each of the front portion, the back portion and the spine portion of the container.

2. The bottle of claim 1, further comprising a medication selectively housed within the container, wherein the label bears printed matter related to the medication.

3. The bottle of claim 1, further comprising a pair of side portions opposite to and spaced from each other, each of the pair of side portions extending between the front portion and the back portion of the container.

4. The bottle of claim 3, wherein each of the pair of side portions comprises a generally rectangular shape, and the front portion of the container extends parallel to the back portion of the container.

5. The bottle of claim 3, wherein each of the pair of side portions comprises a generally trapezoidal shape, and each of the front portion of the container and the back portion of the container extend between the pair of side portions at an angle relative to a vertical plane.

6. The bottle of claim 5, wherein each of the pair of side portions defines a length larger near the first end of the container than near the second end of the container such that the front portion and the back portion of the container are oriented toward convergence with each other near the second end of the container.

7. The bottle of claim 3 wherein the container comprises:

a recessed surface having a generally rectangular shape and extending laterally at least partially across the back portion of the container with the recessed surface having at least one outer edge adjacent one of the pair of side portions of the container; and a contact area defined by the back portion and positioned adjacent the recessed surface, wherein the contact area is generally sized and shaped to receive a first portion of the label, wherein the recessed surface and the contact area of the container are configured relative to each other to cause a second portion of the label to extend over and be spaced from the recessed surface of the container.

8. The bottle of claim 1, further comprising a cap removably coupled with the container to cover the opening, wherein the cap is configured to be placed on a support surface to support the container such that the container extends vertically upward away from the support surface.

9. The bottle of claim 8, wherein the label includes text, and the text on the label is in an upright position over each of the front portion and the back portion of the container when the cap of the container is placed on the support surface such that the container extends vertically upward from the support surface.

10. The bottle of claim 1, wherein the front portion of the container and the back portion of the container are each generally planar.

11. The bottle of claim 1 and further comprising:

a colored ring configured to be removably secured around the opening of the container, wherein the colored ring is selected from a plurality of colored rings.

12. A pharmacy bottle comprising:

a container having:

a front portion, and a back portion spaced from the front portion, the back portion generally facing away and in an opposite direction from the front portion, the back portion defining a recessed surface extending at least partially across the back portion of the container;

a label adhered to the container and extending over and spaced from the recessed surface to define a slot between the recessed surface of the back portion and the label, wherein the slot defines a slot opening near a side edge of the label; and an information card removably maintained at least partially within the slot between the label and the recessed surface of the back portion, wherein the information card can be repeatedly slid into and slid out of the slot via the slot opening.

13. The pharmacy bottle of claim 12, wherein the information card is configured to laterally slide into and out of the slot in a direction generally transverse to a longitudinal axis of the container, wherein the longitudinal axis of the container extends between a top end and a bottom end of the container.

14. The pharmacy bottle of claim 12, wherein the label defines a label back portion generally covered with an adhesive backing except for a non-stick portion of the label back portion, and wherein the non-stick portion of the label back portion is positioned to extend over the recessed surface of the container.

15. The pharmacy bottle of claim 12, wherein a portion of the information card protrudes from the slot opening while the information card is maintained at least partially within the slot.

16. The pharmacy bottle of claim 12, further comprising a medication maintained within the container, wherein the label and the information card each include information relating to the medication.

17. A medication bottle comprising:

means for containing a medication within the medication bottle;

means for covering a portion of the means for containing the medication, the means for covering including printed information relating to the medication;

means for providing additional information about the medication, the means for providing additional information being removably stored between and adjacent to each of the means for containing and the means for covering, wherein the means for providing additional information is configured to be repeatedly slid in between the means for containing and the means for covering to store the means for providing additional information, and the means for providing additional information is configured to be repeatedly slid out from between the means for containing and the means for covering for reference by a user of the medication bottle;

wherein the means for containing defines a front portion, a back portion positioned generally opposite the front portion, an opening positioned between the front portion and the back portion and a spine portion extending between the front portion and the back portion opposite the opening, and the means for covering is adhered to each of the front portion, the back portion and the spine portion of the means for containing.

18. The medication bottle of claim 17, wherein the front portion and the back portion are each generally planar.

19. The medication bottle of claim 17, wherein the front portion and the back portion are orientated toward convergence with each other near the spine portion of the means for containing.

* * * * *